US008533973B2

(12) United States Patent
Ulrich et al.

(10) Patent No.: US 8,533,973 B2
(45) Date of Patent: Sep. 17, 2013

(54) CONTACT FLASH DRYER AND METHOD OF CONTACT FLASH DRYING

(75) Inventors: Dennis S. Ulrich, Coloma, MI (US); Richard A. Biastock, Coloma, MI (US)

(73) Assignee: Mac Engineering and Equipment Company, Inc., Benton Harbor, MI (US)

( * ) Notice: Subject to any disclaimer, the term of this patent is extended or adjusted under 35 U.S.C. 154(b) by 416 days.

(21) Appl. No.: 12/624,756

(22) Filed: Nov. 24, 2009

(65) Prior Publication Data

US 2010/0132213 A1 Jun. 3, 2010

Related U.S. Application Data

(60) Provisional application No. 61/119,251, filed on Dec. 2, 2008.

(51) Int. Cl.
*F26B 7/00* (2006.01)
*F26B 13/00* (2006.01)
*F26B 13/10* (2006.01)

(52) U.S. Cl.
USPC ..... 34/388; 34/482; 34/620; 34/144; 34/236

(58) Field of Classification Search
USPC ..... 34/381, 388, 482, 573, 620, 144, 34/236, 240, 235
See application file for complete search history.

(56) References Cited

U.S. PATENT DOCUMENTS 2,286,595 A * 6/1942 Bleibler ..... 34/60
3,632,733 A * 1/1972 Yazawa ..... 264/342 R
3,944,432 A 3/1976 Brinkmann et al.
3,945,097 A 3/1976 Daniels, Jr. et al.
3,947,936 A 4/1976 Wheadon
4,026,000 A 5/1977 Anderson
4,063,978 A 12/1977 Badger et al.
4,098,685 A 7/1978 Akerlow et al.
4,151,331 A 4/1979 Hug et al.
4,174,004 A 11/1979 Ramsbottom et al.
4,196,757 A 4/1980 Hug et al.
4,220,030 A 9/1980 McDowell
4,241,629 A 12/1980 McDowell
4,262,069 A 4/1981 Devitt et al.
4,275,629 A 6/1981 McDowell
4,284,693 A 8/1981 McDowell
4,308,773 A 1/1982 McDowell
4,336,704 A 6/1982 McDowell
4,338,978 A 7/1982 Devitt et al.
4,342,343 A 8/1982 Clague et al.
4,499,929 A * 2/1985 Shima et al. ..... 141/1.1
4,534,091 A 8/1985 Kline
4,535,040 A 8/1985 Kline
4,551,401 A 11/1985 Wilson
4,656,706 A 4/1987 Mahato et al.
(Continued)

*Primary Examiner* — Jiping Lu
(74) *Attorney, Agent, or Firm* — Barnes & Thornburg LLP

(57) ABSTRACT

An apparatus and method operations are provided for flash drying paste provided on strips of battery plate grids, wherein the paste is dried through contact with a plurality of heated rollers. The plurality of heated rollers are individually driven and heating of the heated rollers is controlled on an individual basis with a feedback loop. The plurality of heated rollers are positioned so as to move the pasted strip of battery plates through contact with the heated rollers; as a result of this contact with the heated rollers, moisture is removed from the paste, so as to provide a pasted strip that with a sufficiently low moisture content to be divided into battery plate grids.

23 Claims, 19 Drawing Sheets

(56) References Cited

U.S. PATENT DOCUMENTS

| | | | | | |
|---|---|---|---|---|---|
| 4,658,623 | A | | 4/1987 | Blanyer et al. | |
| 4,865,933 | A | | 9/1989 | Blanyer et al. | |
| 4,878,521 | A | | 11/1989 | Fredrickson | |
| 4,878,522 | A | | 11/1989 | Ostrander | |
| 4,932,443 | A | | 6/1990 | Karolek et al. | |
| 4,973,218 | A | | 11/1990 | Wirtz et al. | |
| 4,982,482 | A | | 1/1991 | Wheadon et al. | |
| 4,998,340 | A | | 3/1991 | Wheadon et al. | |
| 5,010,637 | A | | 4/1991 | Blanyer et al. | |
| 5,044,067 | A | | 9/1991 | Wheadon et al. | |
| 5,062,762 | A | | 11/1991 | Wirtz et al. | |
| 5,079,111 | A | | 1/1992 | Wheadon et al. | |
| 5,093,971 | A | | 3/1992 | Hein | |
| 5,096,611 | A | | 3/1992 | Matthew et al. | |
| 5,099,982 | A | | 3/1992 | Wirtz et al. | |
| 5,129,643 | A | | 7/1992 | Johnson et al. | |
| 5,264,306 | A | | 11/1993 | Walker, Jr. et al. | |
| 5,276,960 | A | | 1/1994 | Wheadon et al. | |
| 5,290,359 | A | | 3/1994 | Coonen et al. | |
| 5,336,573 | A | | 8/1994 | Zuckerbrod et al. | |
| 5,337,499 | A | * | 8/1994 | Isozaki | 34/549 |
| 5,384,217 | A | | 1/1995 | Binder et al. | |
| 5,385,587 | A | | 1/1995 | Lund et al. | |
| 5,434,025 | A | | 7/1995 | Rao et al. | |
| 5,540,127 | A | | 7/1996 | Binder et al. | |
| 5,577,908 | A | | 11/1996 | Glascock | |
| 5,580,685 | A | | 12/1996 | Schenk | |
| 5,604,058 | A | | 2/1997 | Wirtz | |
| 5,611,128 | A | | 3/1997 | Wirtz | |
| 5,691,087 | A | | 11/1997 | Rao et al. | |
| 5,858,575 | A | | 1/1999 | Chen | |
| 5,871,862 | A | | 2/1999 | Olson | |
| 5,874,186 | A | | 2/1999 | Rao et al. | |
| 5,948,566 | A | | 9/1999 | Larsen et al. | |
| 5,952,123 | A | | 9/1999 | Hatanaka et al. | |
| 5,998,062 | A | | 12/1999 | Olson | |
| 6,013,402 | A | * | 1/2000 | Kanbayashi et al. | 430/45.5 |
| 6,026,722 | A | | 2/2000 | Lopez Ascaso et al. | |
| RE36,734 | E | | 6/2000 | Binder et al. | |
| 6,114,066 | A | | 9/2000 | Nitsche et al. | |
| 6,143,216 | A | | 11/2000 | Loch et al. | |
| 6,182,711 | B1 | | 2/2001 | Wallace et al. | |
| 6,202,271 | B1 | | 3/2001 | Goda et al. | |
| 6,454,977 | B1 | | 9/2002 | Kwok et al. | |
| 6,533,862 | B2 | | 3/2003 | Kokaji et al. | |
| 6,749,950 | B2 | | 6/2004 | Zhang | |
| 6,833,218 | B2 | | 12/2004 | Mann | |
| 6,867,792 | B2 | * | 3/2005 | Hoshino et al. | 347/218 |
| 6,895,644 | B2 | | 5/2005 | Wirtz | |
| 6,949,313 | B2 | | 9/2005 | LaFollette | |
| 6,953,641 | B2 | | 10/2005 | Chen | |
| 7,259,030 | B2 | | 8/2007 | Daniels et al. | |
| 7,331,267 | B2 | * | 2/2008 | Urmson | 83/651 |
| 7,398,581 | B2 | | 7/2008 | Chen | |
| 2007/0264059 | A1 | * | 11/2007 | Maeda et al. | 399/320 |

* cited by examiner

CONTACT FLASH DRYER AND METHOD OF CONTACT FLASH DRYING

This application is a U.S. patent application that relies for priority under 35 U.S.C. 120 on Provisional Application Ser. No. 61/119,251 filed on Dec. 2, 2008, which is incorporated herein by reference.

BACKGROUND

The disclosure relates to electrical battery plate manufacturing. More specifically, the disclosure relates to manufacturing equipment and methodologies for the drying of lead oxide paste or the like to grids that then form battery plates inside an electrical battery.

Conventional battery plate manufacturing involves the application of lead oxide paste to a lead grid or matrix strip (e.g., a continuous cast strip or an expanded metal strip) prior to division of the pasted strip into individual grids or matrices that define the resulting battery plates and support the disposed lead oxide paste. Following the paste application, the applied paste of the pasted strip must be dried, i.e., "flash drying," to some extent sufficient to allow dividing and/or transport to a divider that divides or separates portions of the pasted strip into individual grids or further divides pasted panels into smaller grids of a desirable dimension for subsequent stacking, further drying and curing. Pasted plate strips require this initial flash drying operation to remove excess moisture and are followed by an extensive curing process. The curing process, which may comprise oven drying at high humidity, steam treatment or both, is required to reduce the free lead content and to provide strength and handleability to the plates for further processing.

Conventional flash drying equipment and techniques utilize a drying oven with Infra-Red (IR) heaters, direct-fired burners, or electric duct heaters as well as mechanisms for circulating air within the oven to heat the pasted strip to remove moisture therefrom. Accordingly, such flash drying equipment includes conveyer belts or chains in a configuration that moves the pasted strip through the length of the flash drying oven. Thus, as the pasted strip is heated by increasing the ambient temperature within the flash drying oven, the moisture is removed to some extent as steam and fumes, which are evacuated from the flash drying oven using conventional ventilation techniques.

Because of the conveyor belt configuration that is used to move the pasted strip and because of the amount of heat and length of time that the pasted strip must be exposed to circulated to enable subsequent handling and division, conventional flash drying ovens are large pieces of equipment and often have a length including the inlet and outlet conveyors measuring approximately 24 linear feet (7.3 linear meters), which is significant. Although the size of such conventional flash dryers may be reduced, such a reduction must be accompanied by a reduction in the processing speed of manufacture pasted strip because of the amount of ambient heat that must be applied to the pasted strip.

Accordingly, an illustrated embodiment provided in this disclosure provides an apparatus and method for use in a battery plate fabrication system for contact flash drying lead oxide paste to a battery plate grid strip using a plurality of heated, driven rollers that contact, move and heat a pasted strip through line contact with each roller, wherein each roller is temperature controlled with feedback via a temperature sensor.

Additional features will become apparent to those skilled in the art upon consideration of the following detailed description of drawings exemplifying the best mode as presently perceived.

BRIEF DESCRIPTION OF THE DRAWINGS

The description particularly refers to the accompanying figures in which.

DETAILED DESCRIPTION

Figure 1:
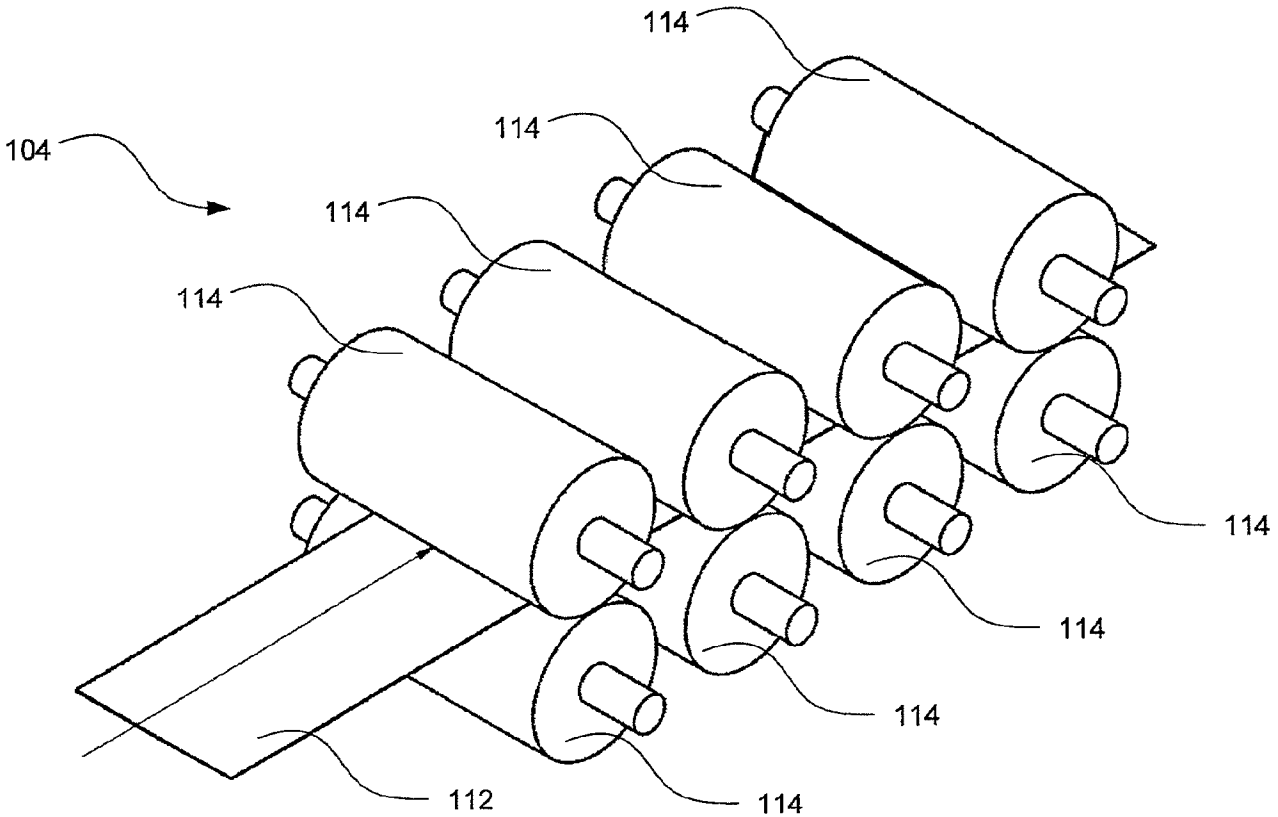
FIG. 1 illustrates a side perspective view of a plurality of heated rollers used in an illustrated embodiment.

While the present disclosure may be susceptible to embodiment in different forms, there is shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

As explained above, conventional "conveyer-type" flash dryers may use a conveyer belt to convey a battery plate grid strip through the dryer wherein the pasted strip is exposed to heated, circulating air so as to induce evaporation of the moisture in the paste provided on the strip.

Thus, conventional flash drying ovens use a combination of heat and air circulation to flash dry a pasted strip prior to the strip being divided into individual battery grids. However, such flash drying ovens are extremely large and take up a considerable about of floor space. Moreover, because the pasted strip is carried along a conveyer belt, there is less heat applied to a bottom side of the pasted strip because of the heat insulation provided by the conveyer belt.

Accordingly, illustrated embodiments described herein provide an apparatus and method for use in a battery plate fabrication system for contact flash drying pasted strips. In an illustrated embodiment, a contact flash dryer is provided that takes up considerably less floor space than conventional flash dryers, while providing a quality product to a next process, e.g., dividing into individual battery grids. For example, a contact flash dryer (as illustrated in FIGS. 3-16) may be approximately 4 feet (1.2 meters) long and 3.5 feet (1.0 meter) wide resulting in a foot print of 14 square feet (1.2 square meters) on a manufacturing floor. Such dimensions are significantly smaller than conventional flash dryers that are approximately 24 feet (7.3 meters) long and 4.5 feet (1.3 meters) wide, which results in a foot print of 108 square feet (9.5 meters) on a manufacturing floor.

Figure 5:
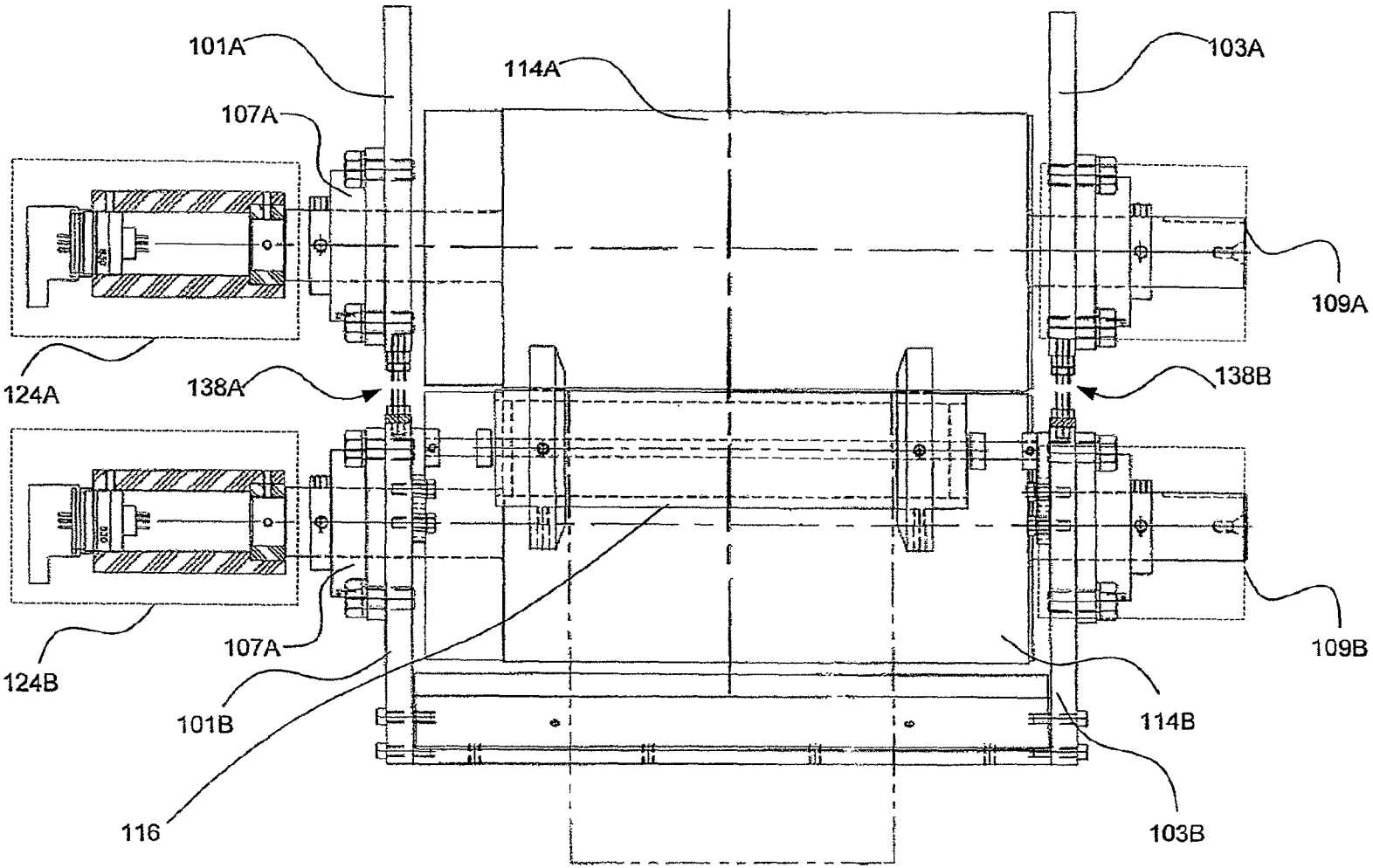
FIG. 5 illustrates an end view of a contact flash dryer designed in accordance with an illustrated embodiment showing particular detail regarding an inlet guide roll layout being representative of the layout of both the dryer inlet end and the dryer outlet end.

As shown in FIG. 1, the contact flash dryer 104 may include a plurality of heated rollers 114 (more specifically, an upper plurality of rollers 114A and a lower plurality of rollers 114B as illustrated, for example, in FIG. 5) that cooperate to apply pressure and heat to a pasted strip 112 passing between the rollers 114 in accordance with an illustrated embodiment. Each of the rollers 114 may be designed for efficient heat transfer to the pasted strips 112. Accordingly, the rollers 114 are heated sufficiently so that each roller temperature may be maintained between approximately 250° Fahrenheit (121° Celsius) and 425° Fahrenheit (218° Celsius). In this regard, it should be appreciated that rollers 114 provided closest to an inlet end of the dryer 104 may be maintained at a lower temperature than rollers 114 provided closer to an outlet end of the dryer 104; such a configuration may be provided if, for example, it is determined that initially exposing a pasted strip 112 to a higher temperature may have adverse affects on the structure or integrity of the strip 112.

In the illustrated embodiment, all of the rollers 114 are driven to ensure that the pasted strip is processed at a uniform speed and the pasted strip 112 is not subject to forces from rollers moving at differing speeds that might result in tearing of the pasted strip 112.

Figure 2:
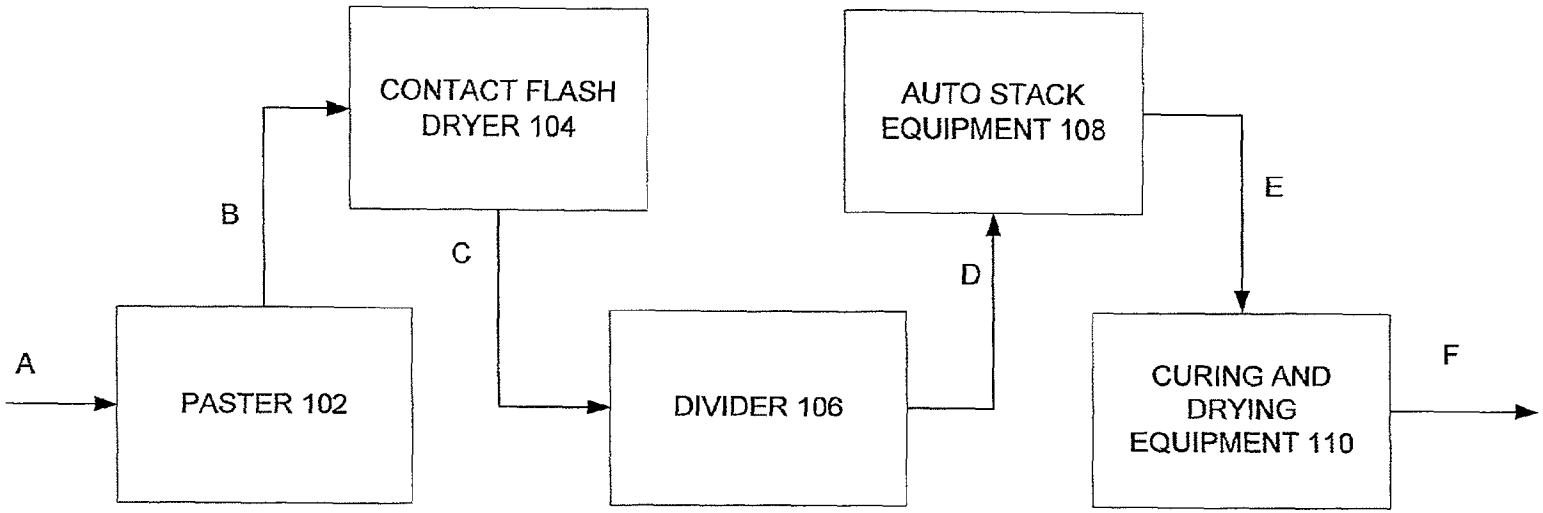
FIG. 2 is a functional block diagram illustrating a method of manufacturing electrical battery plates in accordance with an illustrated embodiment.

FIG. 2 is a functional block diagram illustrating a method of manufacturing electrical battery plates in accordance with an illustrated embodiment. As is conventionally known, a strip including battery plate grids at point A is fed through pasting equipment 102 on a conveyer belt while paste (and optionally backing paper) is applied so as to provide a pasted strip (112 illustrated in FIG. 1). Following application of the paste to the strip, at point B, the pasted strip has a moisture content of approximately 10-13%; however, the paste on the strip must have a much lower moisture content to enable the pasted strip to be divided into pasted battery plates by divider equipment (e.g., divider 106).

Therefore, the pasted strip is fed through the contact flash dryer 104, which, as explained in connection with FIG. 1, includes the plurality of heated rollers 114 that contact the pasted strip 112 for the purpose of drying the paste as well as the purpose of moving the pasted strip 112. As a result of the heat and pressure applied to the pasted strip 112 by the contact flash dryer 104, the contact flash dryer 104 removes approximately 2-3.5% of moisture from the pasted strip 112. Accordingly, at point C, the pasted strip 112 may have a moisture content of approximately 7-8%, which may be sufficiently low to be ready to be divided into pasted battery plates by conventionally known divider equipment 106.

Subsequent to the pasted strip being divided into battery plates or grids by the divider equipment 106, the moisture content at point D remains approximately 7-8%; however, such moisture content is sufficiently low to ensure that the battery plates or grids resulting from division of the pasted strip 112 may be stacked using conventionally known automated stacking equipment 108. As a result, stacks of the resulting battery plates at point E still have a moisture content of approximately 7-8%, which is unacceptably high for battery plate manufacturing. Thus, the stacked battery plates may be transported to curing and drying equipment 110, which processes the battery plates to remove free lead in the paste and reduce the moisture content to approximately 0.5% at point F. Thus, the contact flash dryer 104 of the illustrated embodiment is capable of removing between 2% and 3.5% of moisture from the plates/strip. This allows the material to be handled and stacked before going to the next process, e.g., curing and drying.

Figure 3:
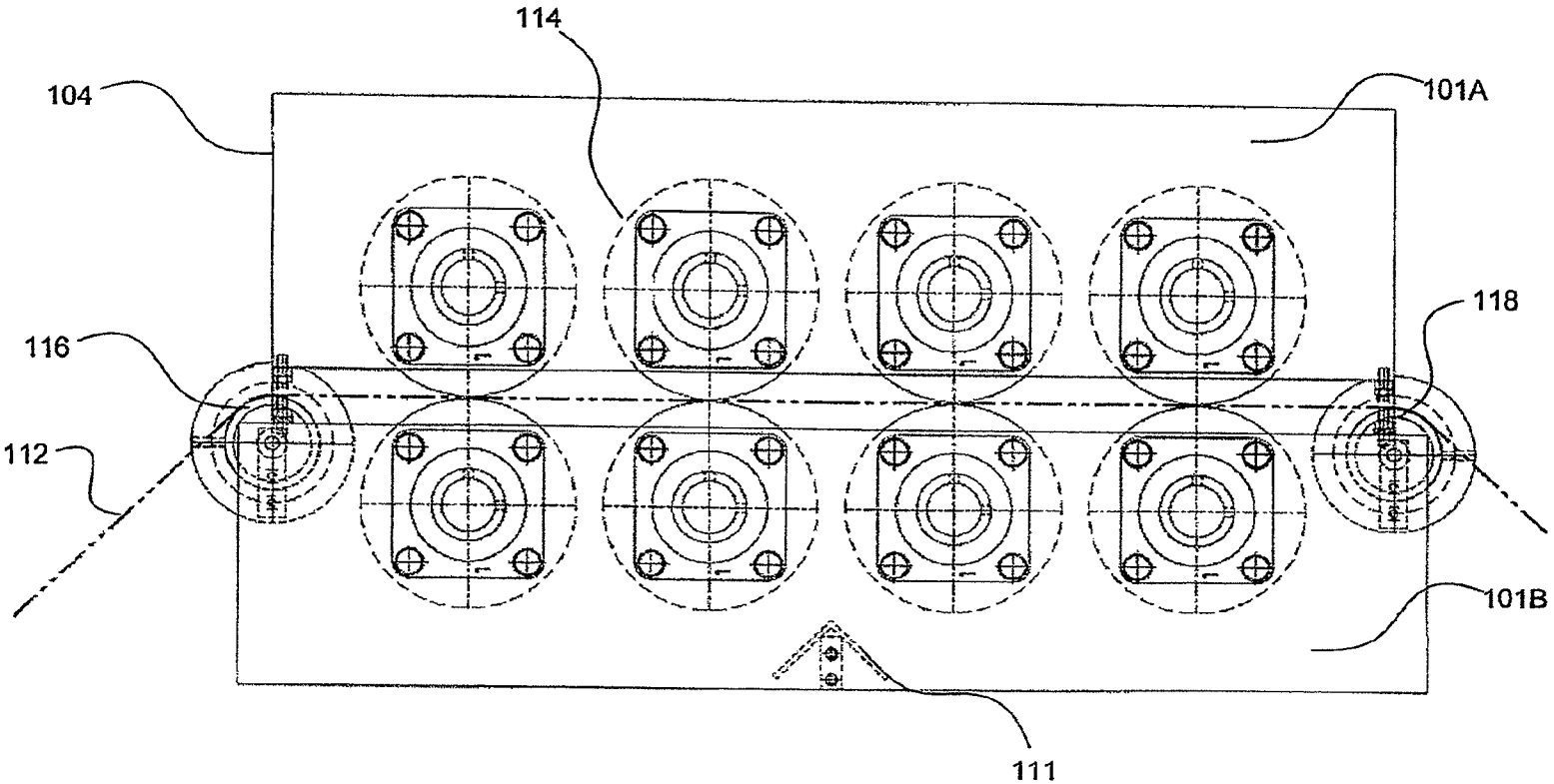
FIG. 3 illustrates a side perspective view of a plurality of heated rollers used in an illustrated embodiment.

FIG. 3 illustrates a side perspective view of a plurality of the driven, heated rollers 114 used in the contact flash dryer 104 in the illustrated embodiment. As shown in FIG. 3, the contact flash dryer 104 processes the pasted strips 112 as the pasted strip 112 is fed through the flash dryer 104 so as to be contacted, heated and moved by the plurality of rollers 114. Accordingly, as explained in connection with FIG. 10 herein, the upper rollers 114A all travel in a counter clock wise direction so as to cooperate to move the pasted strip 112 through the contact flash dryer 104; likewise, lower rollers 114B illustrated in FIG. 5 travel in a clockwise direction.

The rollers 114 of the contact flash dryer may be driven with a motor (an example of which being illustrated as 115 in FIG. 24), for example, a reducer motor powered through a drive system (e.g., drive system 113 illustrated in FIG. 24)*that* may be a torque drive or a standard drive. When implemented as a torque drive, the drive may be controlled by the torque experienced by the pasted strip 112 (as explained with reference to FIGS. 20-23) so as to enable movement of the pasted strip 112 while preventing tearing of the pasted strip 112. Alternatively, the drive may be a standard drive or a drive that enables both torque drive mode and standard drive mode; a standard drive may be less expensive to implement. Such an implementation may have particular utility in providing precise control over the speed of the heated rollers 114 so as to accurately match the speed of a conveyer belt used to convey the pasted strip 112 in the pasting equipment 102 preceding the dryer 104. Thus, in at least one implementation of the manufacturing process illustrated in FIG. 1, the speed at which the pasted strip is moved by the contact of the rollers 114 may be controlled to match the speed of a corresponding conveyer belt on the pasting equipment, e.g., 170 feet/minute (51.9 meters/minute)-200 feet/minute (60.9 meters/minute).

As the pasted strip 112 is contacted by each of the rollers 114, heat is transferred from the heated rollers 114 to the pasted strip 112 and moisture is removed from the paste so as to effect drying of the paste on the battery grid strip 112. Because the contact flash dryer 104 does not include a conveyer belt, the contact flash dryer 104 includes both an inlet guide roller 116 and an outlet guide roller 118. These guide rollers 116, 118 serve to keep the pasted strip material 112 centered as the pasted strip 112 is contacted by the heated rollers 114 and travels through the contact flash dryer 104. Accordingly, the guide roller 116 includes adjustable hubs 126 as explained in more detail in connection with FIG. 6.

As shown in FIG. 3, and as explained in more detail with reference to dryer components for dust collection described herein, the flash dryer 104 includes a dust deflection guard 111 which is positioned and structured to promote paste dust and particles only in designated parts of the contact flash dryer. As should be appreciated from FIG. 3, the heated rollers 114 may be grouped into two groups corresponding to an upper roller carriage including a first upper side wall 101A and a corresponding second upper side wall 103A (see FIGS. 4 and 5) and a lower roller carriage including a first lower side wall 101B and corresponding second lower side wall 103B (see FIG. 5). Thus, the first upper side wall 101A and the first lower side wall 103A are part of or are affixed to a first side wall 101 of the contact flash dryer 104. Likewise, the second upper side wall 103A and the second lower side wall 103B are part of or are affixed to a second side wall 103.

Figure 4:
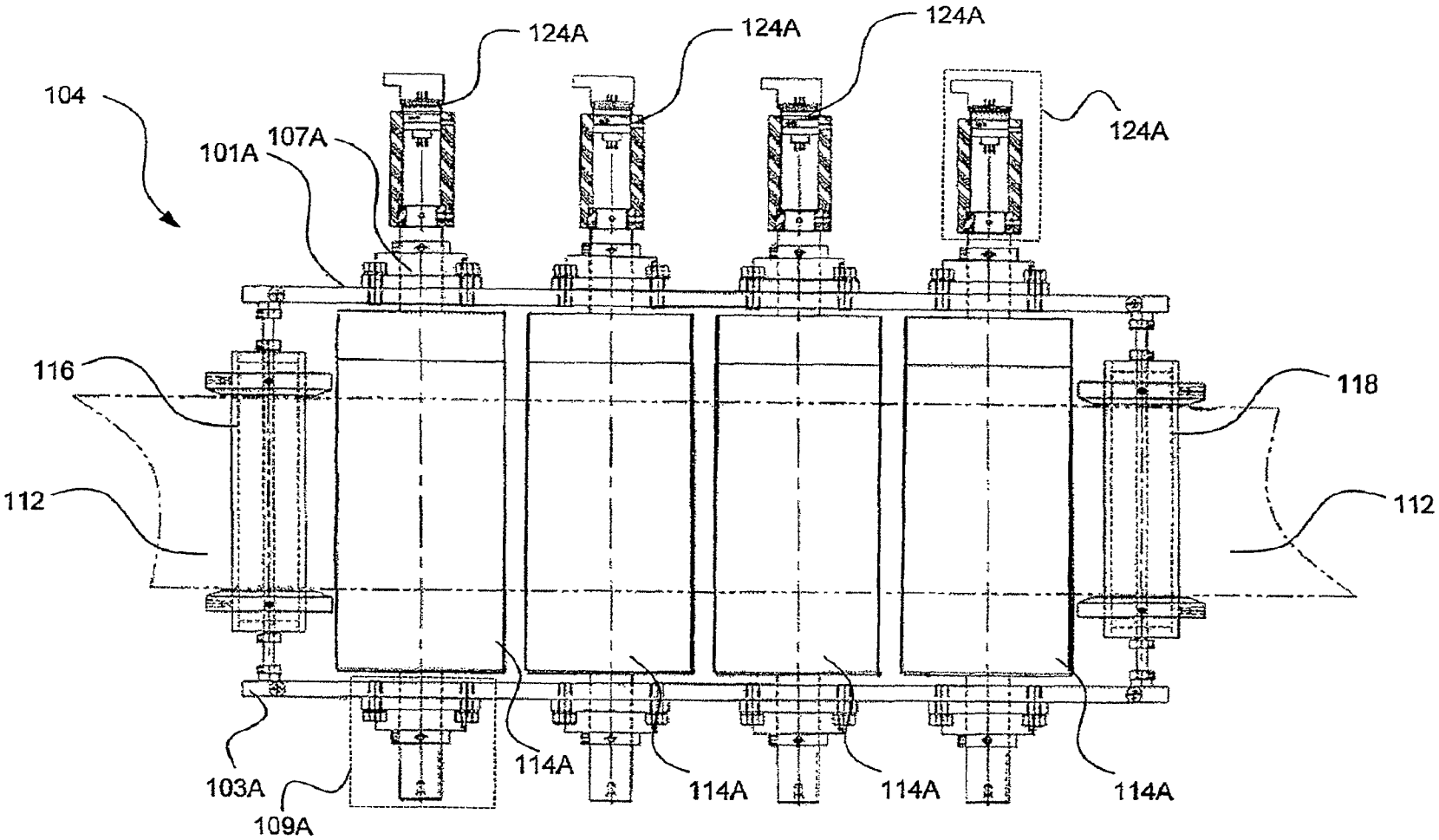
FIG. 4 illustrates a top view of a contact flash dryer designed in accordance with an illustrated embodiment showing particular detail of the inlet and outlet guide roll layout.
Figure 24:
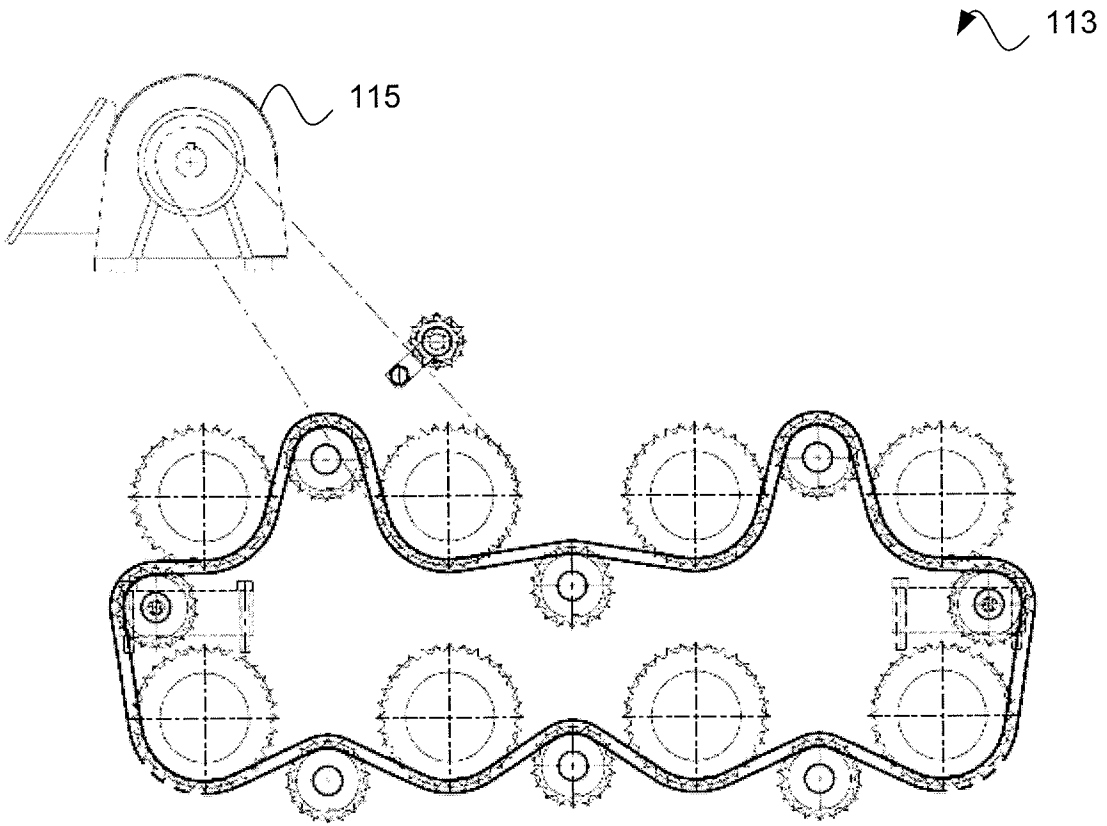
FIG. 24 illustrates an example of a chain and sprocket drive system that may be used to drive the rollers of the contact flash dryer by a single reducer motor in accordance with an illustrated embodiment.

FIG. 4 illustrates a top view of the contact flash dryer 104 and shows both the plurality of upper heated rollers 114A as well as both the inlet guide roller 116 and outlet guide roller 118. The rollers are driven via a chain and sprocket drive system 113, an example of which being illustrated in FIG. 24. As shown in FIG. 24, all of the heated rollers 114 may be driven by a single reducer motor 115. The heating of each of the heated rollers 114A and control thereof is affected through a rotary coupler unit 124A that provides both electrical and data signal connection for the contact flash dryer 104 as well as maintaining that ability of the roller 114A to rotate. Such rotary couplers 124A may be implemented using, for example, a mercury wetted coupling. Each roller 114A is coupled to the upper carriage using a floating bearing structure 107A that enables compensation for expansion of the corresponding heated roller 114 as it expands as a result of heating.

FIG. 5 illustrates an inlet end view of the contact flash dryer 104. As shown in FIG. 5, the inlet guide roll 116 is positioned to be centered along the same median line as both the plurality of upper heated rollers 114A and the plurality of lower heated rollers 114B. Each roller in each group of rollers 114A, 114B (collectively referred to as rollers 114) is driven using a corresponding drive unit 109A, 109B; likewise, the heating of each roller 114A, 114B is effected and controlled through a corresponding rotary coupler unit 124A, 124B, respectively. As shown in FIG. 5, each roller 114 (114A, 114B) interacts with the corresponding floating bearing configuration 107A, 107B.

Although FIG. 5 illustrates the inlet end of the dryer 104, the structure of the outlet end of the dryer 104 is identical to that illustrated except for the replacement of the outlet guide roller 118 for the inlet guide roller 116. As can be seen in FIG. 5, the upper carriage (101A, 103A) and the lower carriage (101B, 103B) include or are affixed to the side walls of the dryer 104.

Figure 8:
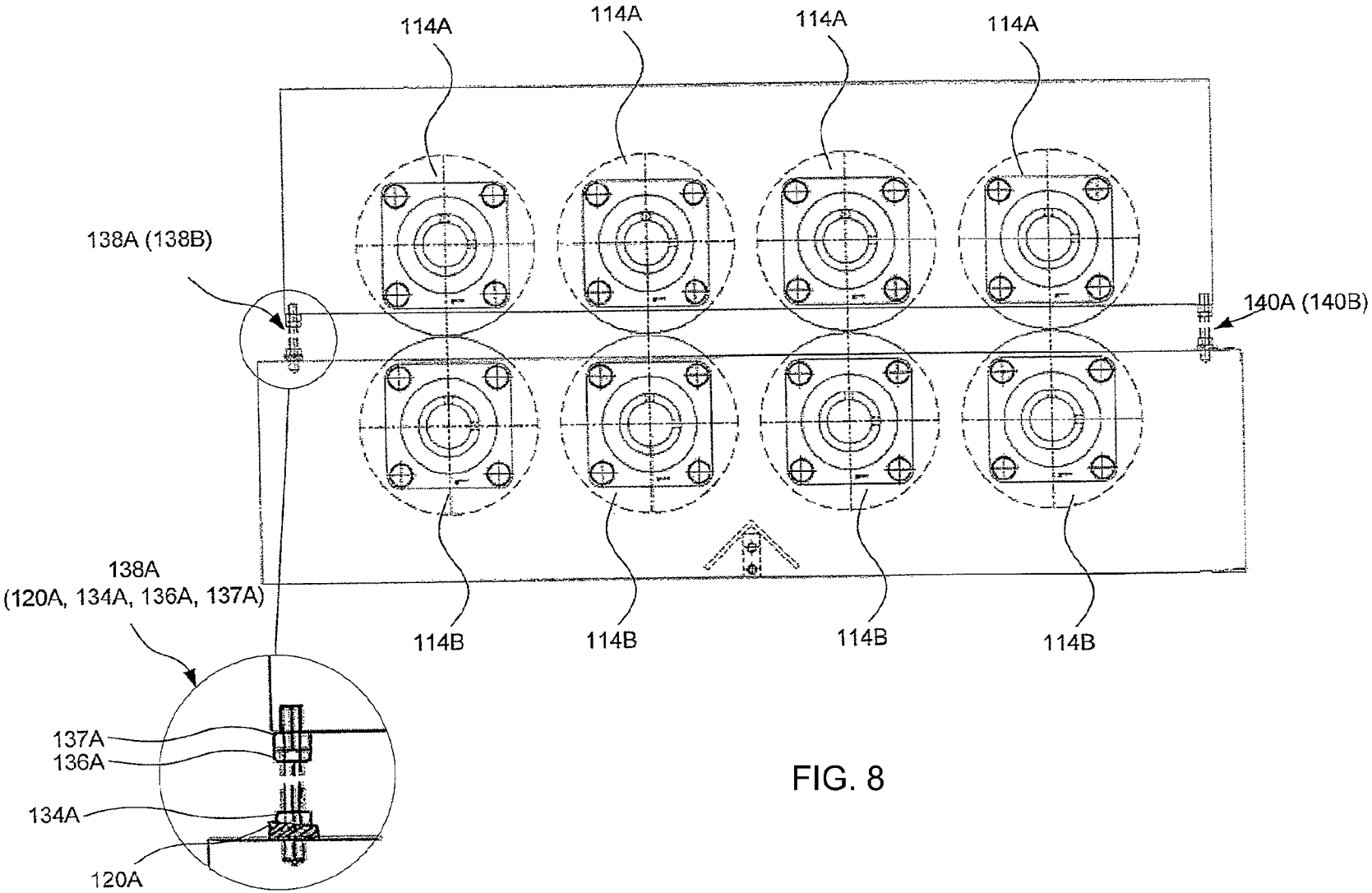
FIG. 8 illustrates a side cross section view of the contact flash dryer of FIG. 3 showing particular detail regarding plate thickness stop shims used in accordance with an illustrated embodiment.

As FIG. 5 illustrates the inlet end view of the dryer 104, the figure shows two of the four stop shim assemblies 138A, 138B included in the dryer 104. The stop shim assemblies 138A, 138B correspond to the inlet end of the dryer 104, while corresponding stop shim assemblies 140A, 140B (as illustrated in FIG. 8) are located at the outlet end of the dryer 104. Each of the stop shim assemblies are located at a corner of the dryer 104 between the upper and lower carriages (101A, 103A) and (101B, 103B) respectively. Details of the stop shim assemblies are explained in more detail in connection with FIG. 8.

Figure 6:
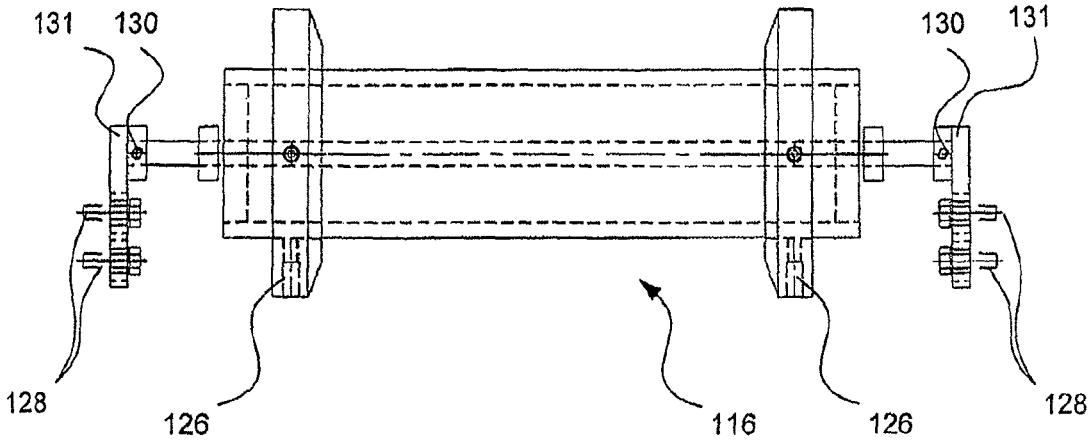
FIG. 6 illustrates a side view of a guide roll with adjustable hubs used in an illustrated embodiment.

FIG. 6 illustrates the inlet guide roller 116 and its constituent parts. Although FIG. 6 illustrates guide roller 116, it should be understood that the inlet guide roller 116 and outlet guide roller 118 are identical in configuration and differ only in their locations within the contact flash dryer 104. The adjustable hubs 126 are provided to guide the pasted strip material as it travels through the contact flash dryer 104. The adjustable hubs 126 have particular utility for the dryer 104 because the dryer 104 does not include a conveyer belt for carrying the pasted strip. The locations of these hubs 126 along the guide roller 116 are adjustable along the length of the guide roller 116 to compensate for pasted strips of differing widths.

Figure 7:
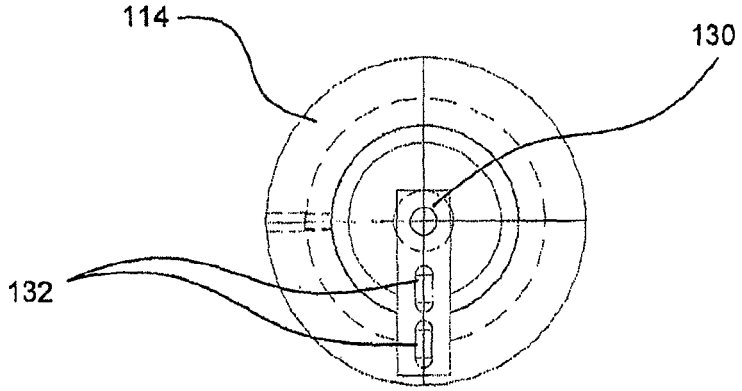
FIG. 7 illustrates an end view of the guide roll illustrated in FIG. 6 and including a slotted bracket for vertical adjustment of the guide roll.

As shown in FIG. 7, the vertical position of each of the guide rollers 116, 118 may be adjusted by altering the positioning of a roller axis collar 130 of the guide roller by altering the vertical positioning of the bracket 131, which includes the roller axis collar 130. This adjustment may be performed by adjusting the positioning of the slotted bracket apertures 132 of the each of the respective brackets 131, which is affixed to a corresponding side wall (e.g., 101A-B, 103A-B, as illustrated in the remaining figures) of the contact flash dryer 104 via screws.

As illustrated in FIG. 8, stop shim assembly 138A (representative of the structure of each of the stop shim assemblies 138A-B, 140A-B) includes a stop shim 120A, a leveling bolt 134A, nut 136A and leveling bolt lock nut 137A. By manipulating the constituent components of the stop shim assembly 138A, the vertical distance between the pluralities of rollers, i.e., between the rollers 114A and the rollers 114B can be adjusted. The stop shim 120A may set in a hole in the lower carriage sidewall 101B.

The upper roller carriage 101A, 103A is kept aligned with the lower roller carriage 101B,103B using the four stop shim assemblies 138A-B, 140A-B, which each include vertical alignment shafts and bearings. The lower carriage 101A, 103A is raised and lowered by an air cylinder (not shown). Thus, the upper roller carriage 101A, 103A sets on top of the stops shims 120A inserted into the bottom carriage 101B, 103B that are sized for the pasted plate/strip thickness specification. These stop shims 120A are easily changed when running different thickness material. This is because materials processed by the dryer 104 may differ in thickness depending on the specifications of the battery plates to be manufactured; thus, materials processed by the dryer 104 may range in thickness from, for example, 0.036 inches to 0.113 inches (0.91 centimeters to 0.29 centimeters).

To change the stop shim 120A, the lower carriage (101B, 103B) is lowered, e.g., by approximately 0.5 inches (1.25 centimeters) and a stop shim 120A of a particular height is replaced with a stop shim 1120A of a differing height; subsequently the lower carriage (101B, 103B) is repositioned. The replacement of the stop shim 120A in each of the stop shim assemblies 138A-B, 140A-B may be performed simultaneously or in a serial manner.

Figure 9:
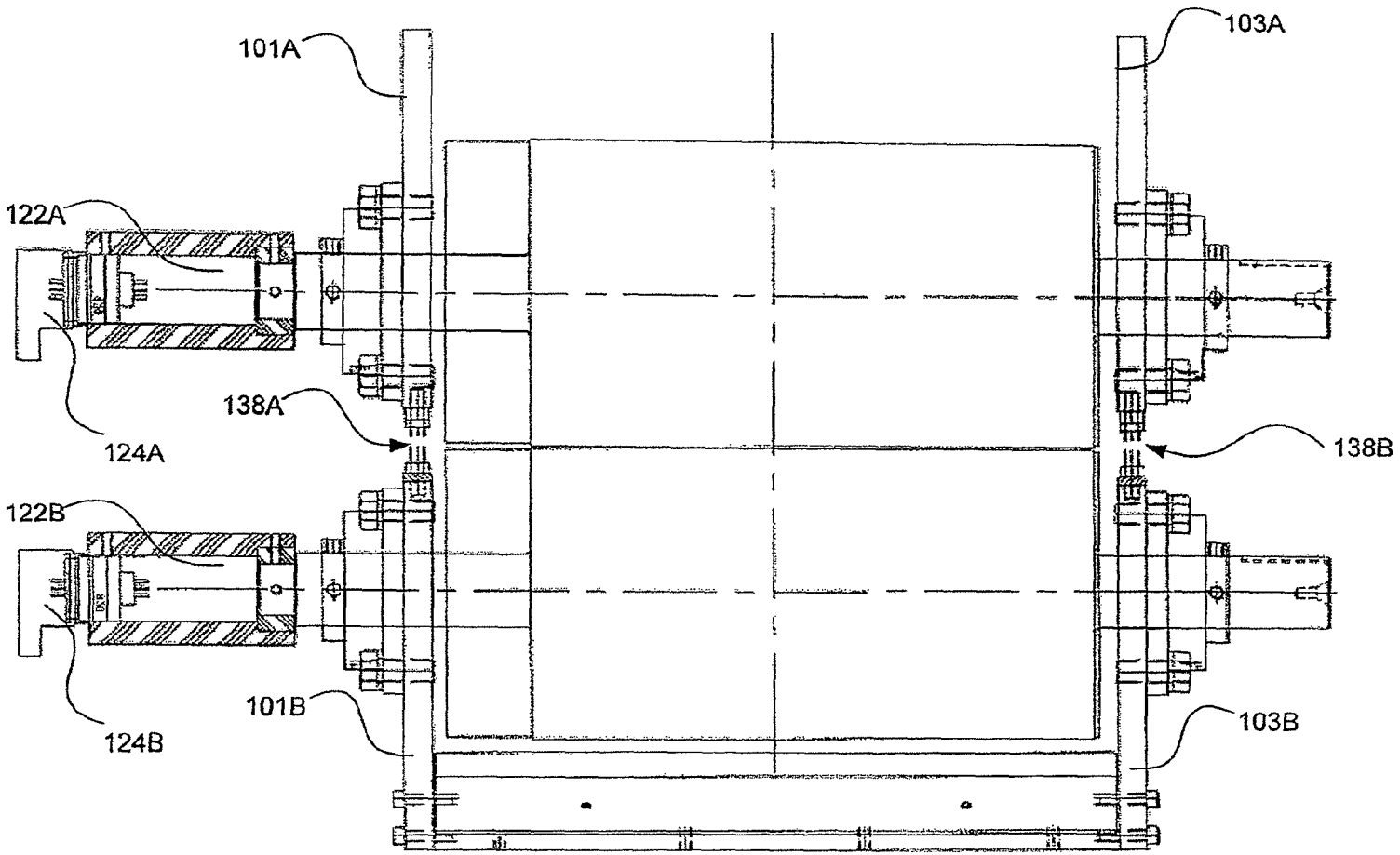
FIG. 9 illustrates an end view of the contact flash dryer of FIGS. 3 and 8 showing particular detail regarding plate thickness stop shims used in accordance with an illustrated embodiment.

As mentioned above, the stop shim assemblies 138A-B, 140A-B are identical and differ only by location. Thus, as illustrated in FIGS. 8 and 9 stop shim assemblies 138A, 138B correspond to the inlet end of the dryer 104 while stop shim assemblies 140A, 140B correspond to the outlet end of the dryer 104. Accordingly, stop shim assemblies 138A, 140A are on one side of the dryer 104, while stop shim assemblies 138B, 140B are on the other side of the dryer 104.

Figure 10:
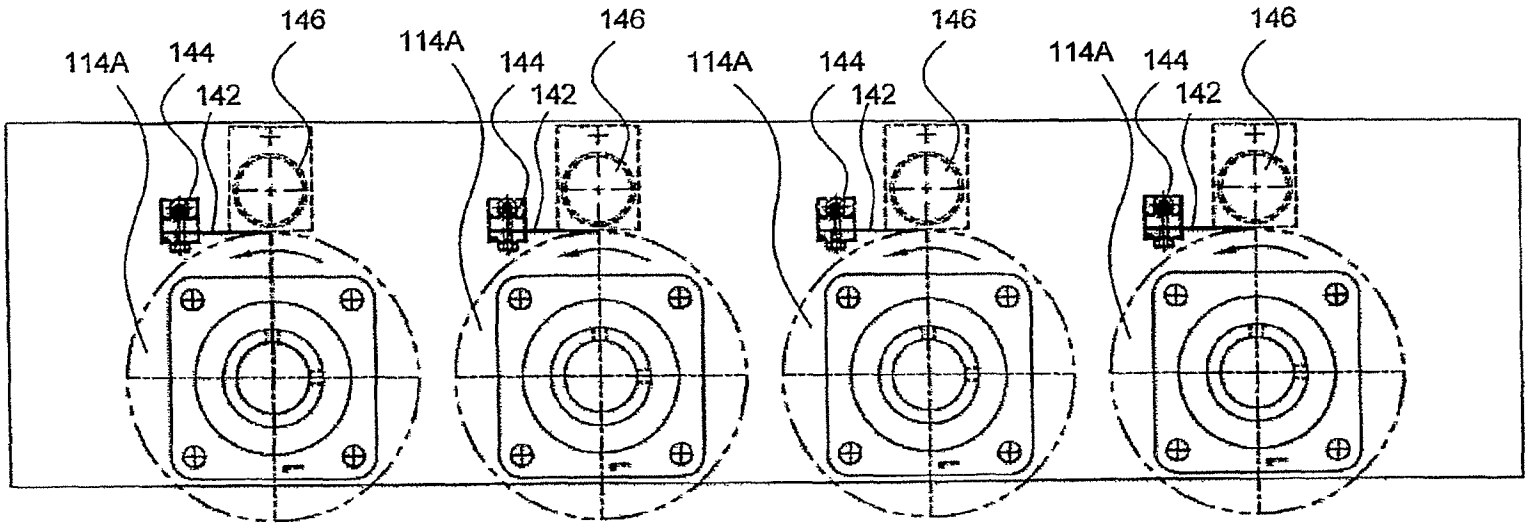
FIG. 10 illustrates a side cross section view of a top plurality of heated rollers as used in the contact flash dryer of FIG. 3 and showing particular detail regarding top scraper dust collection components used in accordance with an illustrated embodiment.

As a result of the heat and pressure applied by the heated rollers 114 (114A, 114B) on a pasted strip 112, partially dried paste (i.e., lead oxide) carried on the pasted strip 112 may adhere to the heated rollers 114 (114A, 114B). However, for proper operation of the dryer 104, that residual past is scraped off of the heated rollers 114 by scraper blades each associated with one of the plurality of rollers. Therefore, as illustrated in FIG. 10, the upper plurality of heated rollers 114A each have a corresponding scraper blade 142 positioned in relationship to the surface of the corresponding heated roller 114A to scrape off residual paste. Such scraper blades 142 may be implemented as plates, grates or the like acting as stops forcing some or all of paste carried by a heated roller 114(114A, 114B) to be separated there from. Thus, the scraper blades 142 may be provided to help remove at least a portion of the dust and dried paste (i.e., lead oxide) that builds up on the heated rollers 114(114A, 114B).

The scraper blade 142 is held in position by a scraper blade assembly 144, explained in more detail with reference to FIGS. 11-12. By operation of the scraper blades 142, paste dust and particles are generated and are evacuated from the interior of the dryer 104 using exhaust tubes 146, which each correspond to a particular heated roller 114A of the upper carriage 101A, 103A. This ventilation also removes the steam that is created when the pasted strips 112 contact the heated rollers 114 (114A, 114B). Thus, the ventilation reduces the lead oxide particulate content in and around the dryer 104. Corresponding components for the lower plurality of heated rollers 114B are explained with reference to FIGS. 13-16.

As shown in FIG. 10, the heated rollers 114A on the upper carriage 101A, 103A rotate in a counter clockwise direction to contact the pasted strip 112 and move the strip 112 through the dryer 104 in a processing direction (left to right illustrated in FIG. 10). Likewise, although not illustrated in FIG. 10, the heated rollers 114A on the lower carriage 101B, 103B rotate in a clockwise direction to contact the pasted strip 112 and move the strip 112 through the dryer 104 in the processing direction.

Figure 11:
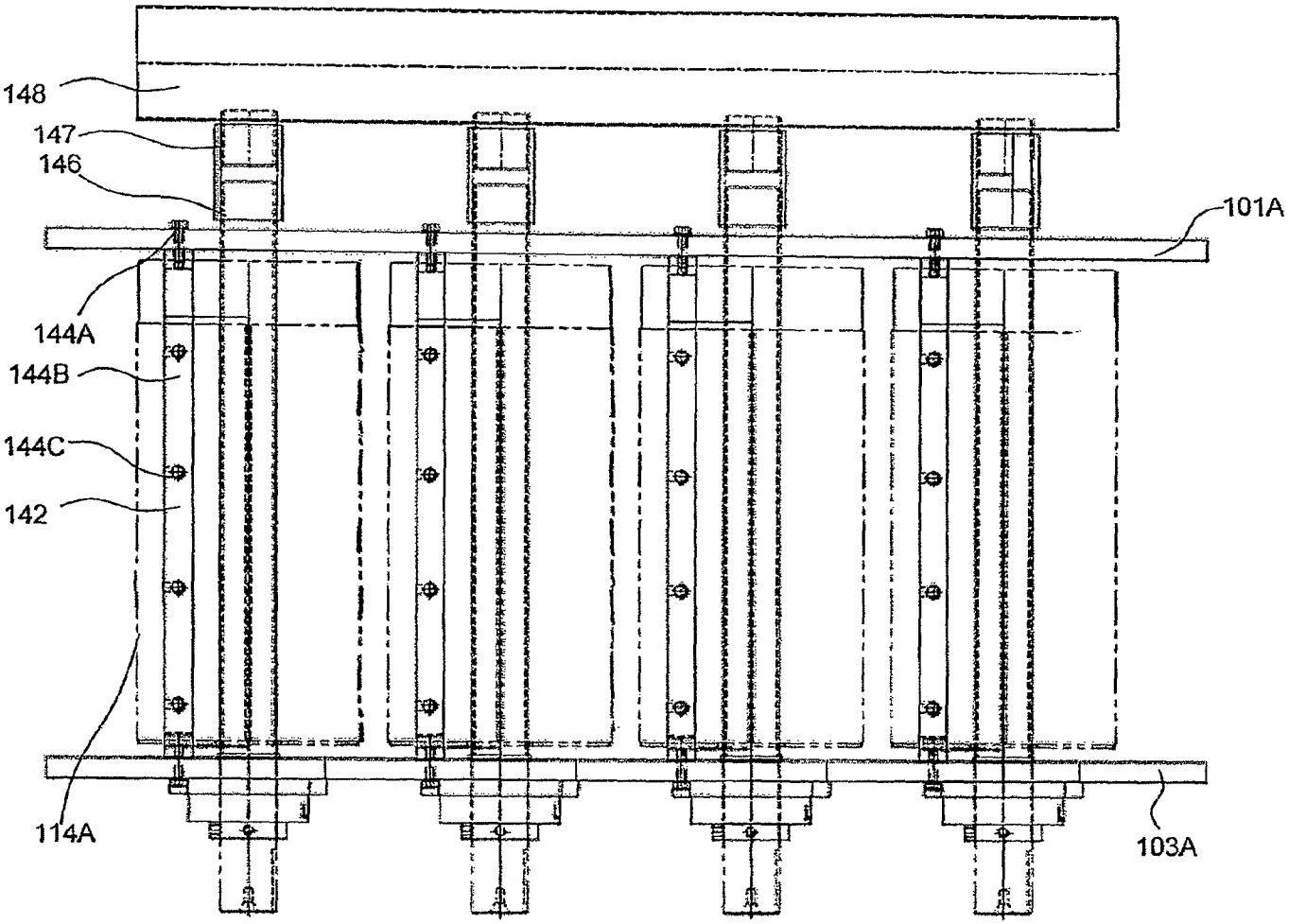
FIG. 11 illustrates a top view of the contact flash dryer of FIGS. 3 and 10 showing particular detail regarding top scraper dust collection components used in accordance with an illustrated embodiment.
Figure 12:
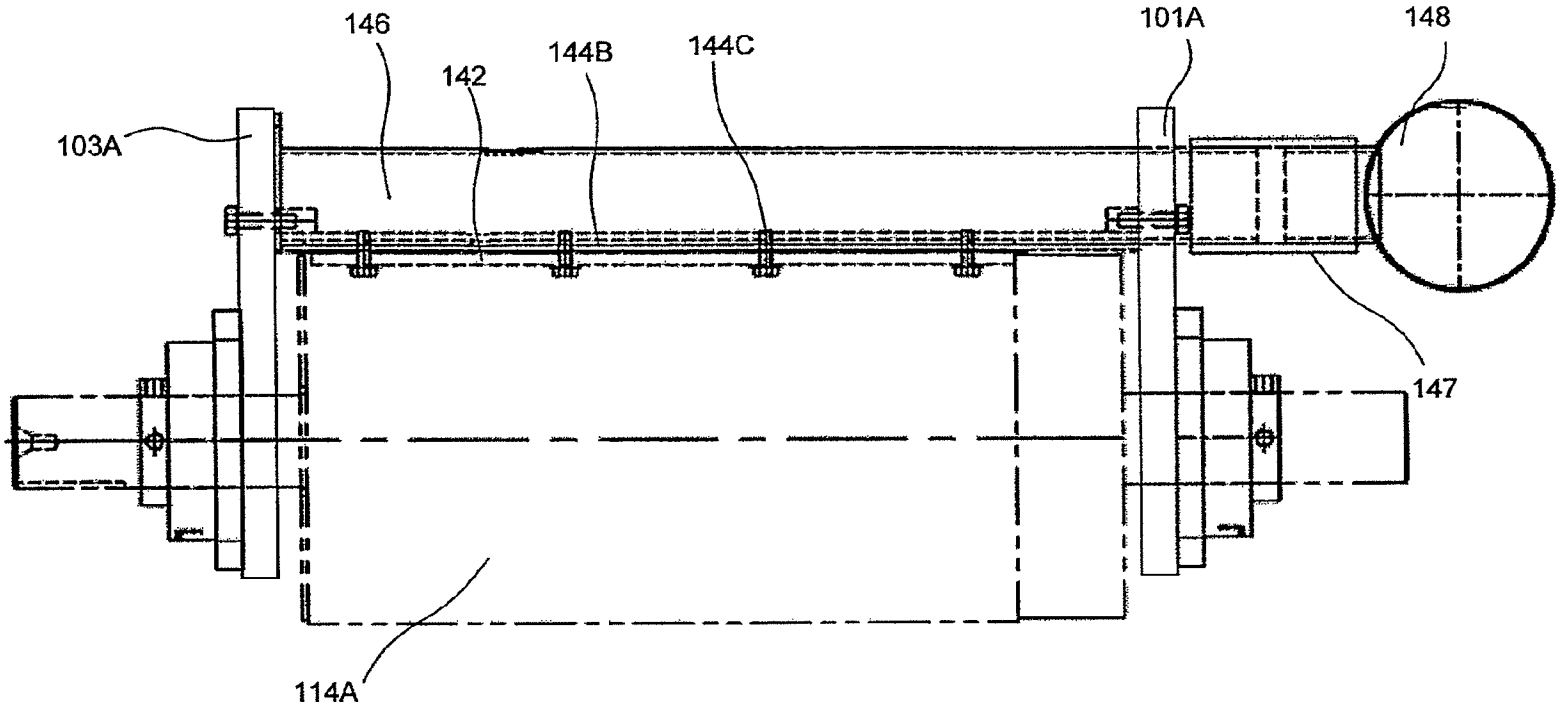
FIG. 12 illustrates an end view of the contact flash dryer of FIGS. 3 and 9-10 showing particular detail regarding top scraper dust collection components used in accordance with an illustrated embodiment.

FIG. 11 illustrates a top view of the contact flash dryer 104 illustrated in FIG. 10 showing particular detail regarding the upper roller scraper components including the scraper blade 142, the scraper blade assembly 144 and ventilation components provided to remove the paste dust and particulates. As shown in FIG. 11, the scraper blade assembly 144 includes a plurality of bolts 144A, 144C. Bolt 144A is provided to affix the assembly 144 (as a whole) to the roller carriage (here the upper roller carriage 101A, 103A). The bolts 144C are provided to affix the scraper blade 144 to a corresponding scraper blade mount 144B. FIG. 12 illustrates an end view of the contact flash dryer components illustrated in FIG. 11. As may be seen in FIG. 12, the scraper blade 142 is coupled to the scraper blade mount 144B via the bolts 144C.

Also illustrated in FIG. 11, the roller-specific exhaust tubes 146 are each coupled to an exhaust manifold 148 that spans the entire length of the dryer 104 between the inlet and outlet ends. Each roller-specific exhaust tube 146 is coupled to the exhaust manifold by a coupler 147. As shown in FIG. 12, the roller-specific exhaust tubes 146 run the entire length of the scraper blade 142.

Figure 13:
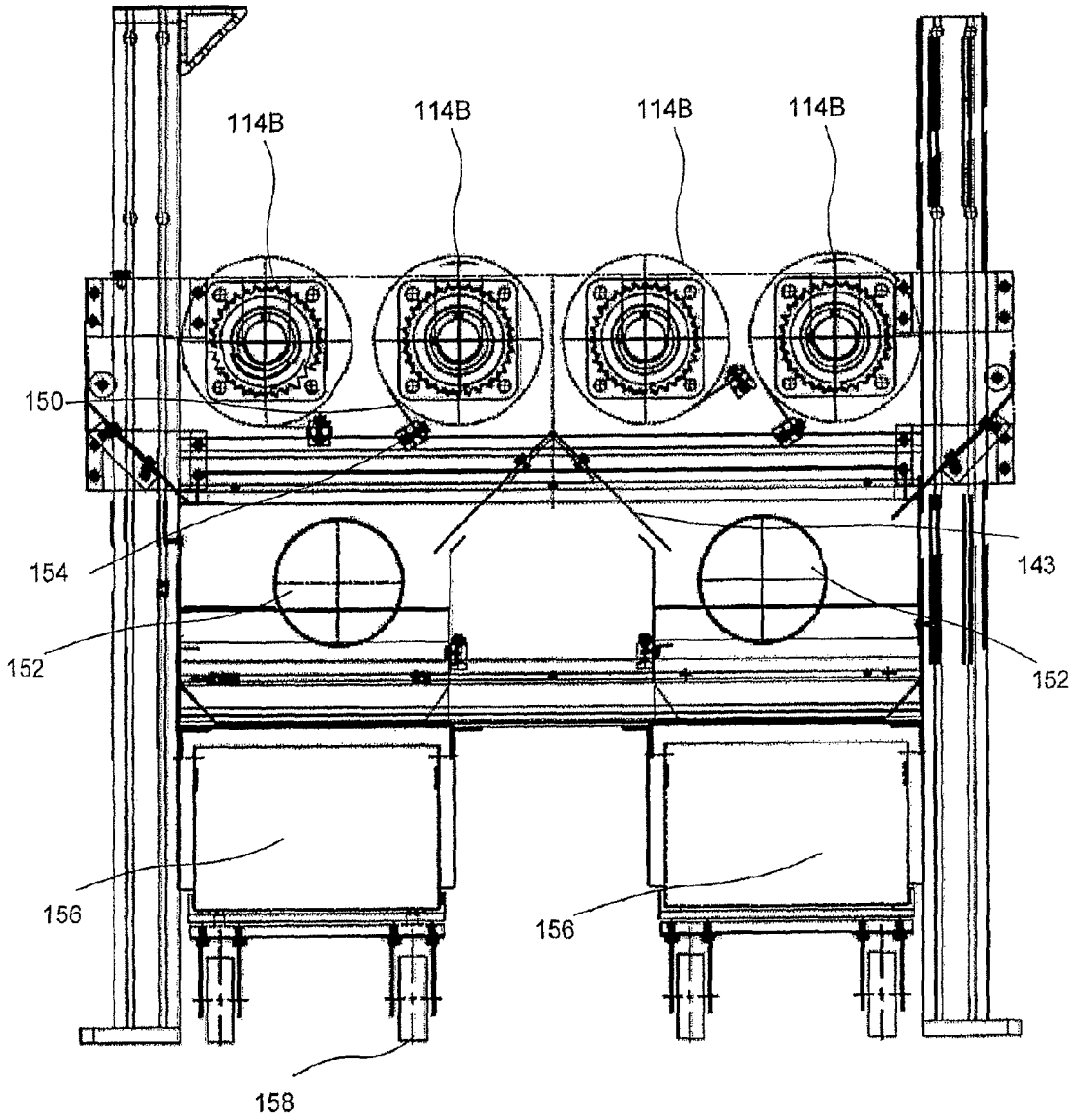
FIG. 13 illustrates a side cross section view of a bottom plurality of heated rollers as used in the contact flash dryer of FIG. 3 and showing particular detail regarding bottom scraper dust collection components used in accordance with an illustrated embodiment.

As mentioned above, both the upper and lower pluralities of heated rollers 114A, 114B each have associated scraper blades. As shown in FIG. 13, the scraper blades 150 (which are identical to the scraper blades 142) are each held in position with respect to their corresponding rollers 114B by a scraper blade assembly 154, which is identical to the scraper blade assembly 144 explained above in detail with reference to FIGS. 11-12. Thus, by operation of the scraper blades 150, paste dust and particles are generated and are to be evacuated from the interior of the dryer 104. Accordingly, exhaust ducts 152 are provided below the rollers 114B and are coupled to a ventilation mechanism (not shown), e.g., fans, blowers, vacuums, etc., to remove dust and paste particulates created when the pasted strips 112 contact the heated rollers 114B. This ventilation reduces the lead oxide particulate content in and around the dryer 104.

Figure 14:
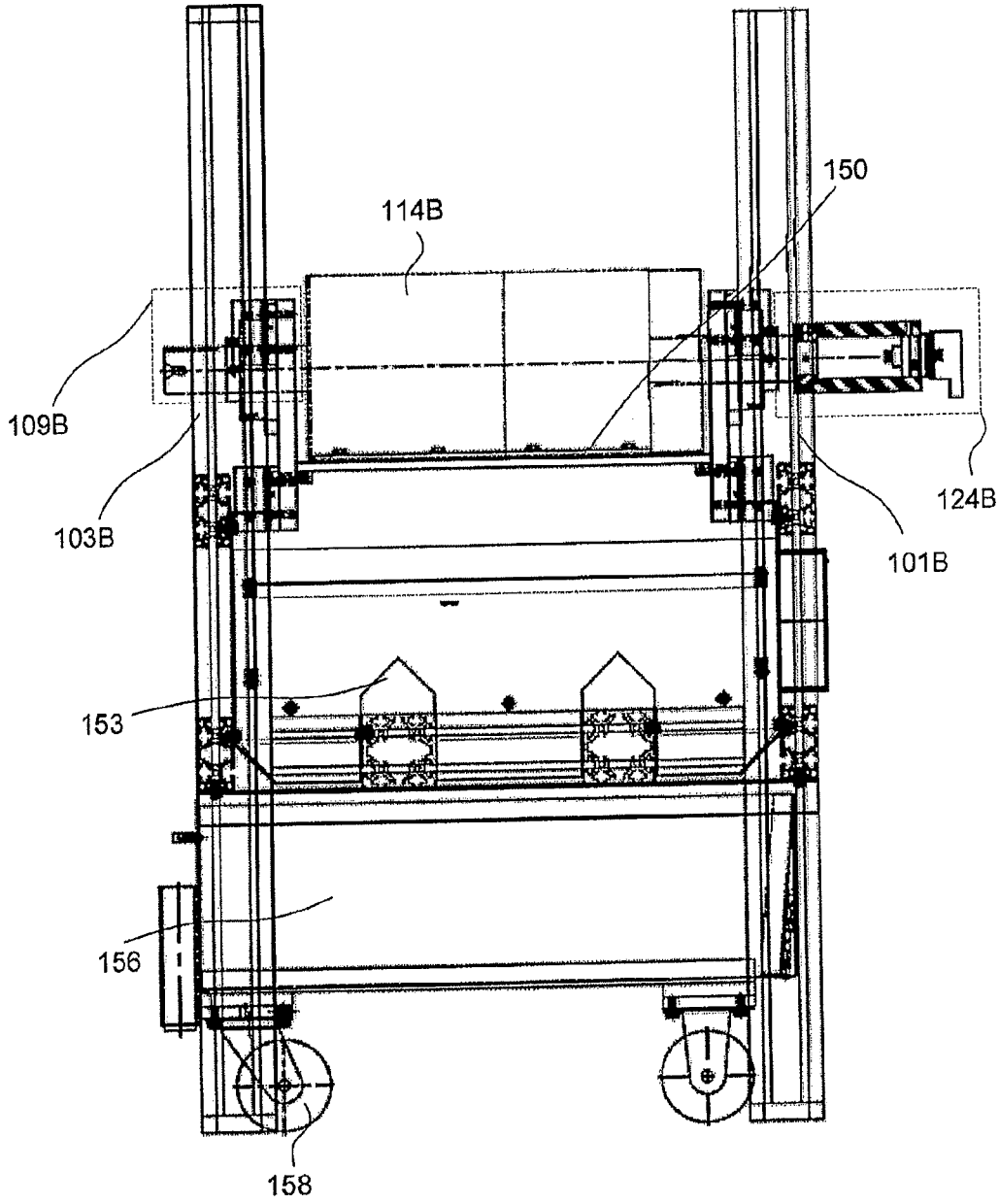
FIG. 14 illustrates an end view of the contact flash dryer of FIGS. 3 and 13 showing particular detail regarding bottom scraper dust collection components used in accordance with an illustrated embodiment.

As shown in FIG. 13, dust and particulates are directed to waste bins 156 via operation of the exhaust ducts 152 and the physical configuration of the interior of the dryer 104; more specifically, the upper center deflector 143 and other illustrated sloping members ensure that dust and particulate matter settles by gravity in proximity to the waste bins 156 (see also angled guide member 153 illustrated in FIG. 14).

Figure 15:
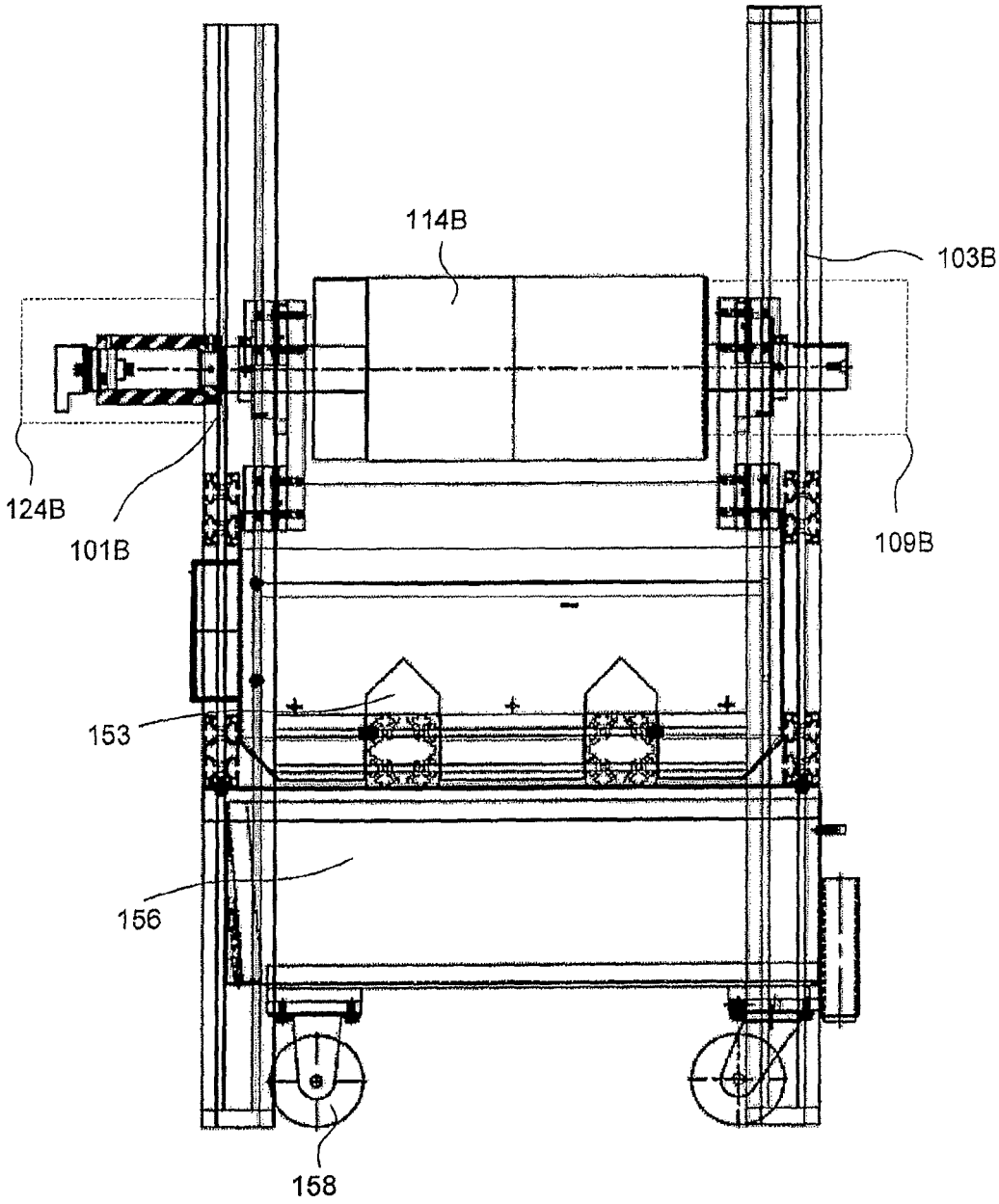
FIG. 15 illustrates a second end view of the contact flash dryer of FIGS. 3 and 13-14 showing particular detail regarding bottom scraper dust collection components used in accordance with an illustrated embodiment.
Figure 16:
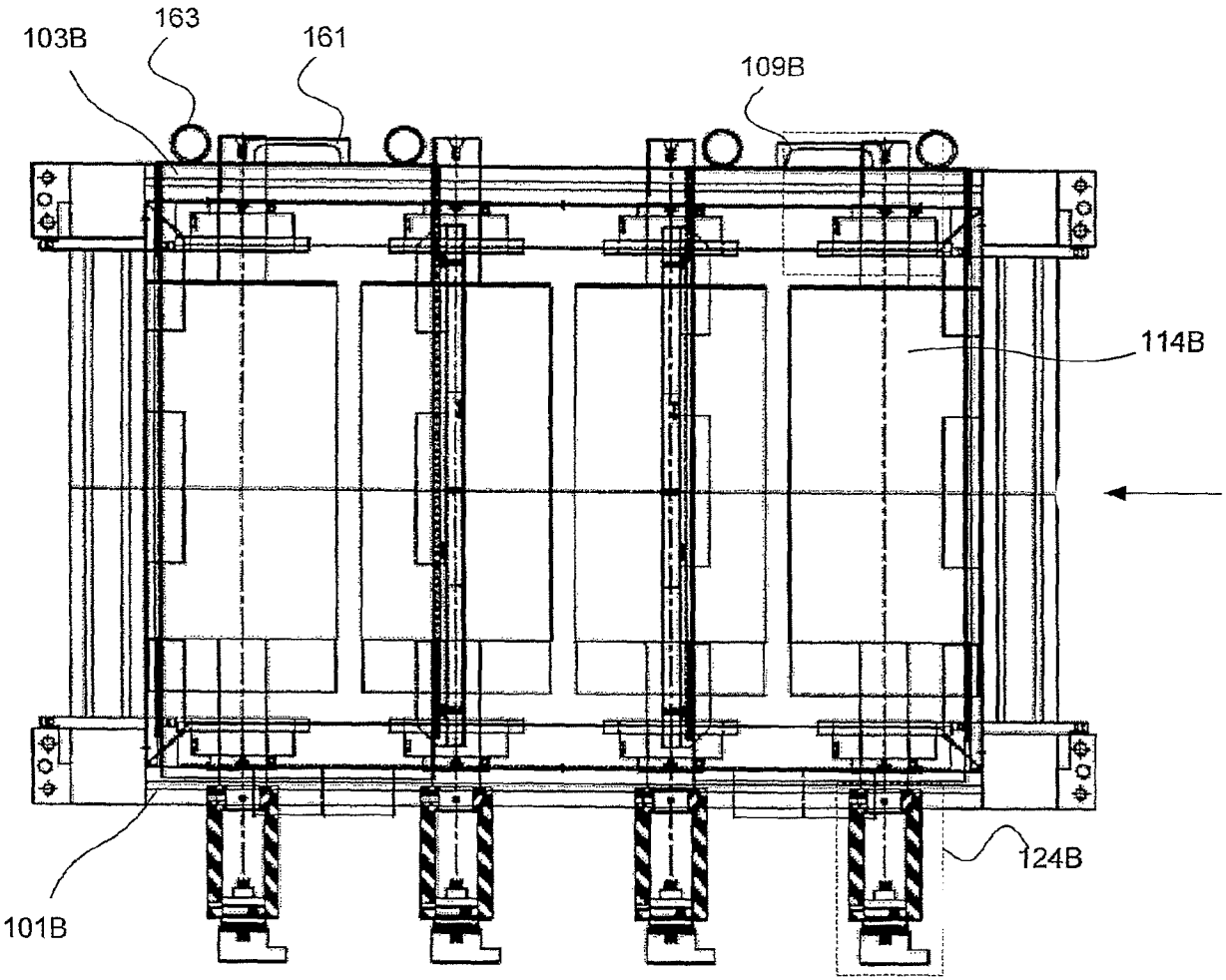
FIG. 16 illustrates a top view of the contact flash dryer of FIGS. 3 and 13-15 showing particular detail regarding bottom scraper dust collection components used in accordance with an illustrated embodiment.

These waste bins 156 serve to collect the generated lead oxide particulate and may be provided on rollers 158 to facilitate removal of the bins 156 from the dryer 104 so that the bins 156 may be emptied as necessary. Thus, as illustrated in FIGS. 14-15, the waste bins 156 may each span the entire width of the dryer 104 between the sidewalls (101A-B, 103A-B). Likewise, as illustrated in FIG. 16, handles 161, 163 may be provided on one side of each waste bin 156 (not visible in FIG. 16 but shown in FIGS. 14-15) to enable movement of the waste bin 156 into and out of a corresponding cavity in the dryer 104.

Figure 17:
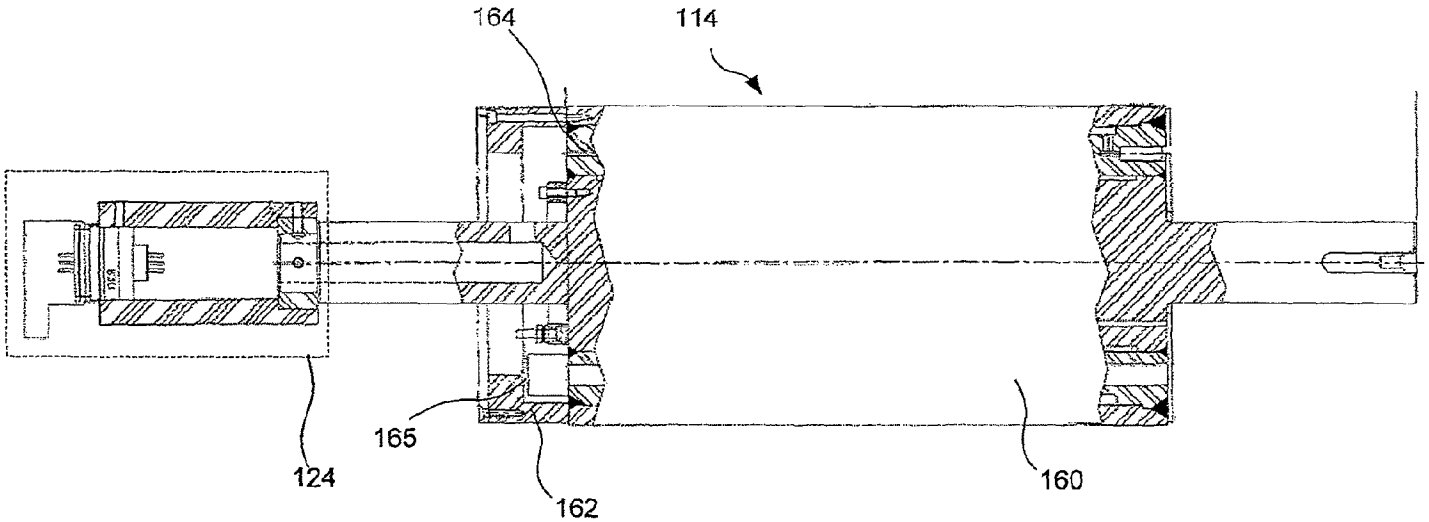
FIG. 17 illustrates a side cross section of one example of a heater roller that may be utilized in a contact flash dryer designed in accordance with an illustrated embodiment.
Figure 19:
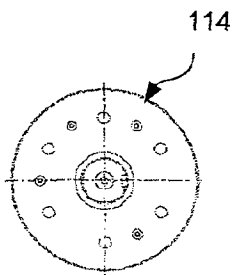
FIG. 19 illustrates a second end view of the heater roller illustrated in FIG. 17.
Figure 18:
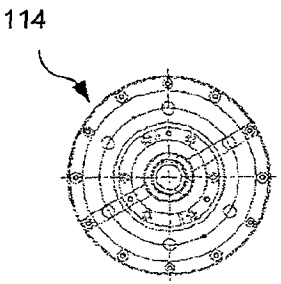
FIG. 18 illustrates a first end view of the heater roller illustrated in FIG. 17.

Although the particular heated roller design utilized in the contact flash dryer 104 of the illustrated embodiments is not central to the utility of the contact flash dryer, FIGS. 17-19 illustrate various views of one example of a heated roller suitable for use in the disclosed contact flash dryer 104. Such a heated roller may be purchased from one of various roller companies, for example, the American Roller Company of Union Grove, Wis. Such rollers 114 may have a diameter of approximately 8 inches (20.3 centimeters), 250 pounds (113.4 kilograms) and have a maximum operating temperature of approximately 450° Fahrenheit (232.2° Celsius).

FIG. 17 illustrates a side cross section of the heater roller 114 (114A, 114B) that may be utilized in the contact flash dryer 104 designed in accordance with an illustrated embodiment. As shown in FIG. 17, a heater roller 114 (114A, 114B) may include a core 160, end cap 162 and temperature sensor assembly 164. The core 160 may be comprised of an appropriate metal that may be heated to necessary temperatures for the contact flash dryer application described herein. The end cap 162 may be provided at the end of the core 160 and may serve to contain the electrical couplings and other conventionally known components that enable the heated roller to function as described herein. For example, because each roller 114 (114A, 114B) may be heated by heaters 165 and controlled to maintain a temperature on an individual basis, each roller 114 (114A, 114B) has its own temperature sensor assembly 164; this temperature sensor assembly 164 detects the temperature on the surface of the respective heated roller 114 (114A, 114B) and outputs a signal indicating that temperature for use by a control system for the dryer 104, in a feedback loop configuration, as explained in further detail in connection herein with reference to FIGS. 20-24.

Accordingly, the temperature sensor assembly 164 may include or be implemented, for example, as a thermocouple. Such a thermocouple may be, for example, a ring thermocouple that is removable from a respective heater roller 114 (114A, 114B) along with other conventionally known heated roller components including, heater cartridges, mercury welded couplers, etc. included in the heater roller. Thus, the heaters 165 in each roller 114 (114A, 114B) may be controlled via, for example, Silicon Controlled Rectifier (SCR) power controllers (not shown) that modulate the output to the heaters 165 for accurate control over the temperature of the roller 114 (114A, 114B). Use of such SCR controllers may be superior to the use of binary contactor controllers, which may simply provide power to the heaters 165 in a binary manner (i.e., full on, full off); thus, in using SCR power controllers, the operation of the heaters 165 in each roller 114 (114A, 114B) are more precisely controlled.

As shown in FIG. 17, one end of the roller 114 (114A, 114B) interacts with a corresponding rotary coupler unit 124 described above. FIGS. 18 and 19 show respective ends of the roller illustrated in FIG. 17.

Figure 20:
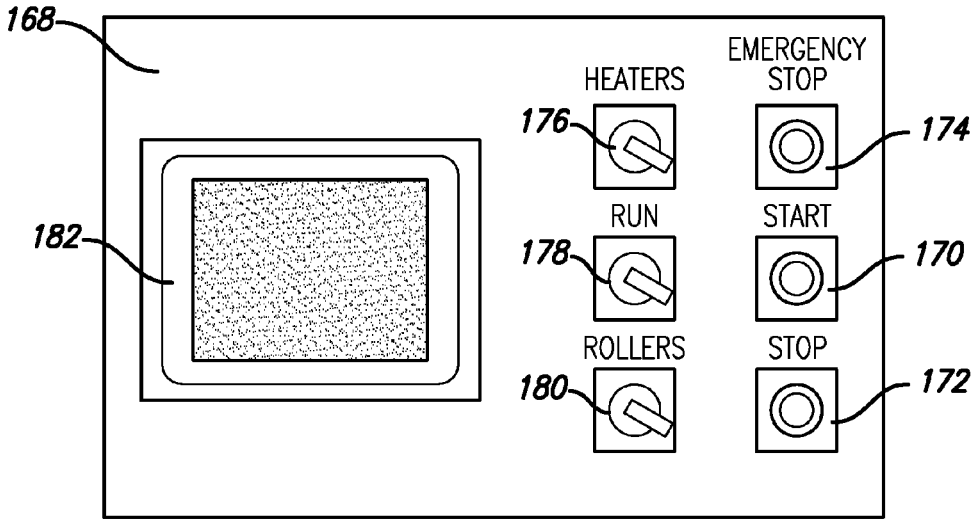
FIG. 20 illustrates an example of a control panel configuration configured to control operation of a contact flash dryer designed in accordance with an illustrated embodiment.

FIG. 20 illustrates an example of a control panel 168 configured to control operation of the contact flash dryer 104 designed in accordance with an illustrated embodiment. Control of the contact flash dryer 104 may be performed using, for example, a programmable automation controller (not shown) that transmits control signals to the various rollers 114 (114A, 114B) to control movement and heating of the rollers 114 (114A, 114B). Control instructions for programming such a programmable automation controller may be input to the control panel 168 with a Touch-screen Human Machine Interface (HMI) implemented in part using a Graphical User Interface (GUI) 182.

As shown in FIG. 20, the control panel 168 may include a plurality of buttons and switches configured to control overall operation of one or more components of the contact flash dryer 104. Thus, as shown in FIG. 20, the control panel 168 may include a start button 170, which, when pressed, initiates start up of the dryer 104. Likewise, the control panel 168 may include a stop button 172, which when pressed, initiates shut down of the dryer 104. Further, the control panel 168 may include an emergency stop 174, which when pressed, immediately shuts down the dryer 104 and, in particular, operation of certain components of the dryer 104 (e.g., movement of the rollers 114 or conveyer belt 112) that may cause a hazard to human operators or processed materials.

Likewise, as shown in FIG. 20, the control panel 168 includes a set of switches 176-180 configured to control operation of the heaters (switch 176), the mode of operation (switch 178) and the rollers (180), which may be, for example, toggle switches. More specifically, a human operator may manipulate the switch 176 to turn on or off the heating elements included in the rollers 114 (114A, 114B). Likewise, a human operator may manipulate the switch 176 to switch between manual operation or automatic operation (explained herein); further a human operator may manipulate switch 178 to rotate the rollers 114 (114A, 114B) of the dryer 104 forwards or backwards (appreciating that the upper rollers move counter clockwise when moving in a forward direction while the lower rollers move clockwise when moving a forward direction).

The control panel 168 may also include a touch-screen HMI implemented at least in part using a GUI 182 provided via a monitor included in the panel 168. This GUI 182 may display icons, which are configured to enable control and adjustment of various operation parameters of the dryer 104, via a programmable automation controller used to provide automated or manual control of the dryer 104. Thus, an automated control mode (AUTO mode) may enable the operation of the dryer 104 based on certain parameters programmed via the GUI 182 or enable operation of the dryer 104 to be controlled based on parameters set externally, for example, controlling the speed of the pasted strip 112 to match the speed of the conveyer belt of the pasting equipment 102 illustrated in FIG. 2. In such a situation, the rotation rate and the temperature of each of the rollers 114 (114A, 114B) would also be affected by this speed because the faster the pasted strip is generated by the pasting equipment 102, the fast the rollers 114 (114A, 114B) must rotate and, generally speaking, the higher the temperature of the rollers 114 (114A, 114B) must be to remove moisture from the pasted strip.

Figure 21:
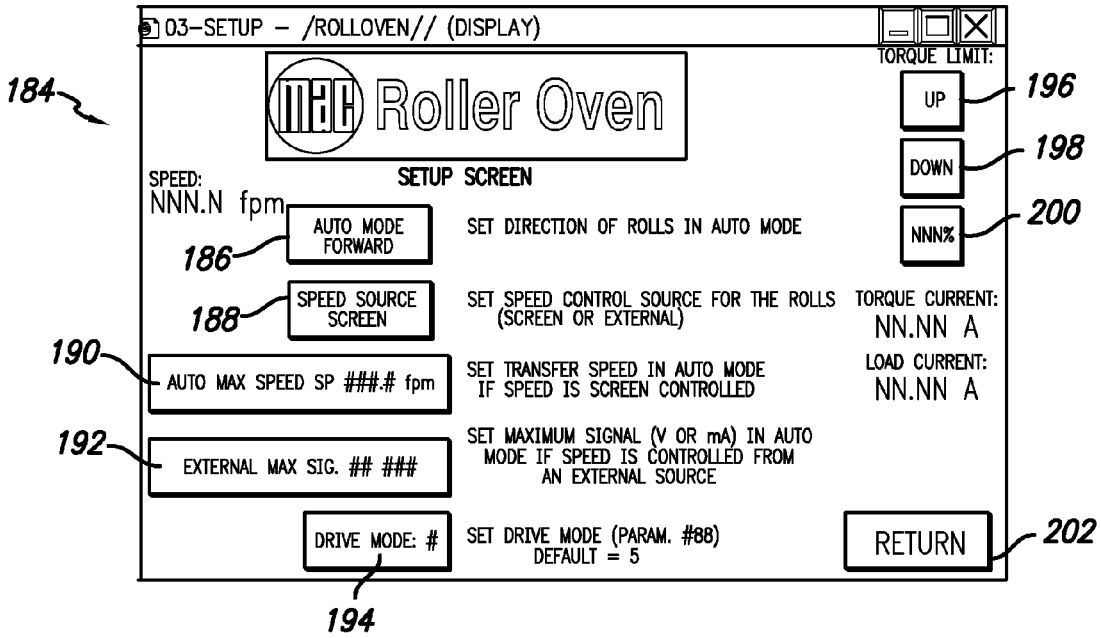
FIG. 21 illustrates an example of a setup screen provided as part of a Graphical User Interface (GUI) used to control operation of a contact flash dryer designed in accordance with an illustrated embodiment.

FIG. 21 illustrates an example of a setup screen 184 provided as part of the GUI 182 used to control operation of a contact flash dryer 104 designed in accordance with an illustrated embodiment. As shown in FIG. 21, an operator may select the direction of the rollers in AUTO mode using icon 186; likewise an operator can set using the speed source screen icon 188 so that the control source for controlling the rotation rate of the rollers can be controlled from the GUI 182 through the setup screen 184 (using, for example, the auto max speed icon 190 to set the transfer speed in AUTO mode if the speed is screen controlled). Alternatively, the speed control source can be set using the icon 188 so that an external source is controlling the rotation rate of the rollers 114 (114A, 114B). For example, a signal from the paster equipment 102 (illustrated in FIG. 2) indicating at what rate it is generating and outputting pasted strip for processing by the dryer 104 may be used). In such a situation, the icon 192 can be used to set the maximum signal (e.g., Volts or Milli-Amperes) in AUTO mode if the dryer processing speed (which controls the speed of the roller 114) is controlled from an external source.

A drive mode (AUTO mode versus a less automated MANUAL mode) may be selected using the drive mode icon 194. Additionally, the setup screen 184 may be used to set and adjust the torque limit (icon 196 to increase, icon 198 to decrease the percentage value displayed in the torque limit field icon 200) for the torque drive of the reducer motor (e.g., motor 115 illustrated in FIG. 24) driving the rotation of the rollers 114 (114A, 114B). As there are multiple screens in the GUI 184, the setup screen 184 also may include a return icon 202, which may be used to navigate to a previously displayed screen.

Figure 22:
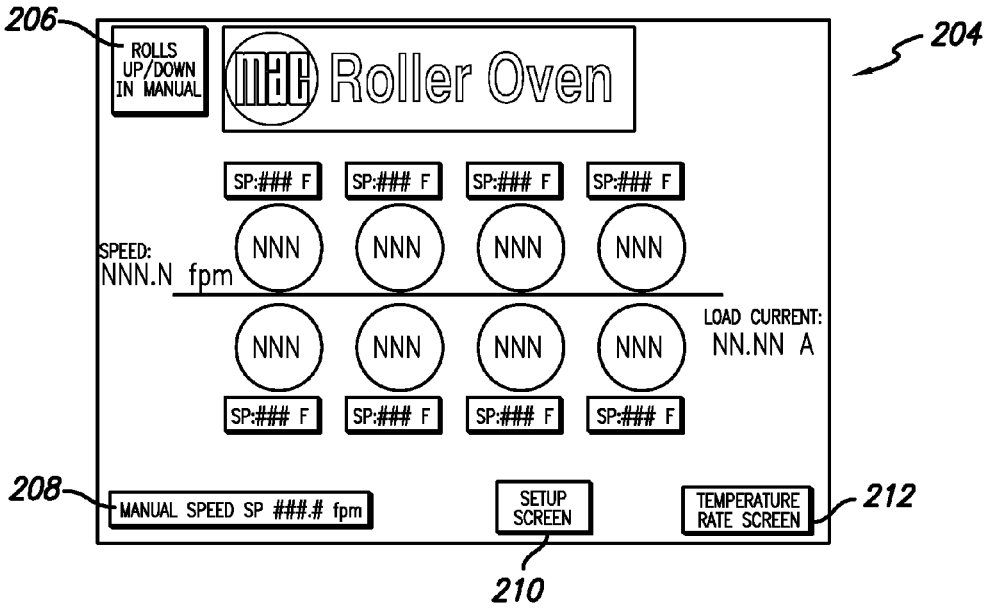
FIG. 22 illustrates an example of a main controller screen provided as part of a GUI used to control operation of a contact flash dryer designed in accordance with an illustrated embodiment.

One such screen is a main controller screen 204, an example of which being illustrated in FIG. 22. The main controller screen 204 may be used to control ongoing operation of a contact flash dryer 104 designed in accordance with an illustrated embodiment. Thus, the screen 204 provides icons that enable the setting and adjustment of the temperature set-point for each roller 114 (114A, 114B). Additionally, to the extent that the dryer 104 is in a Manual mode of operation (i.e., not being controlled to some extent by machine settings), the icon 208 may be utilized to set and adjust the manual speed of the rollers in, for example, feet per minute (or meters per minute).

Figure 23:
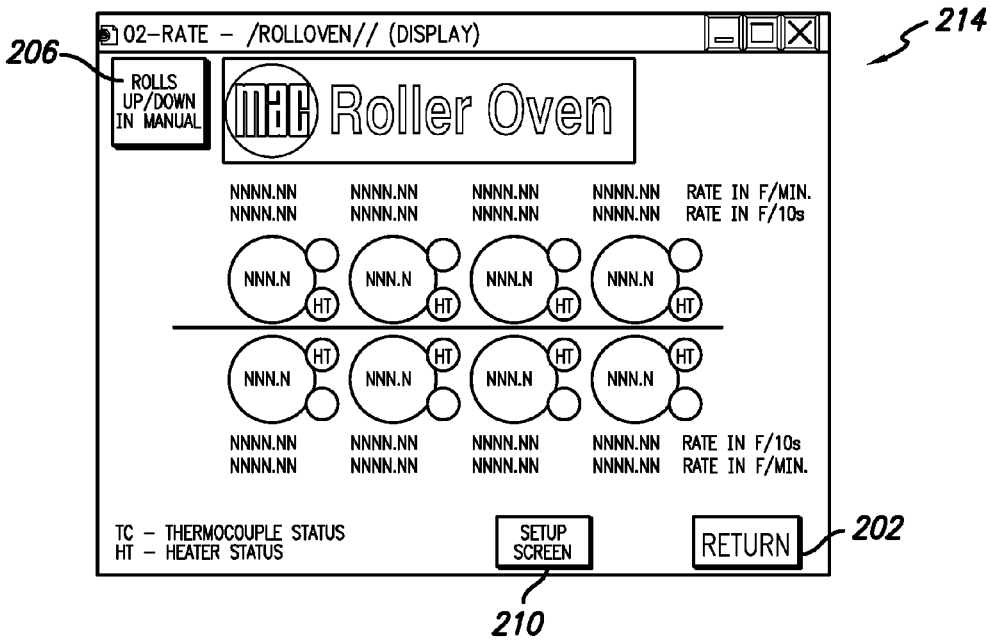
FIG. 23 illustrates an example of an optional temperature control screen that may be provided as part of a GUI used to control operation of a contact flash dryer designed in accordance with an illustrated embodiment.

FIG. 23 illustrates an example of an optional temperature control screen 214 that may be provided as part of a GUI 182 used to control operation of a contact flash dryer designed in accordance with an illustrated embodiment. This control screen may be utilized to set and adjust the temperature of each of the heated rollers 114 (114A, 114B). However, such a control screen may not be necessary depending on the type of SCR power controller used in each of the rollers 114 (114A, 114B); more specifically, the PID Loop settings may be set using a controller such as an Allen Bradley Control/Compact Logix controller (manufactured by Rockwell Automation Allen Bradley; in such an implementation, Proportional-Integral-Derivative (PID) controller loop settings may be set in the control/compact logix controller. Thus, an AUTO/MANUAL mode selection function may simply be controlled with the run selector switch 178 on the operator control panel 168.

As a result of the various combination of components illustrated in FIGS. 1-19, in illustrated embodiments, the contact flash dryer 104 produces a pasted strip with a reduced moisture content while maintaining the utility provided by conventional conveyer-type pasting machines, e.g., relatively high production rates. Further, by utilizing the pressure of the plurality of heated rollers 114 (114A, 114B) on the pasted strip 112, added utility may also be provided when the pasted strip 112 is sandwiched between backing paper by the pasting equipment (e.g., pasting equipment 102 illustrated in FIG. 2) or other equipment provided in between the pasting equipment and the contact flash dryer 104. When such optional backing paper is applied to the top and/or bottom of the pasted strip, the plurality of rollers 114 (114A, 114B) in the contact flash dryer 104 may not only heat the pasted strip 112 so as to dry the paste on the strip but the contact of the rollers 114 (114A, 114B) may also further press of the backing paper on the exterior of the pasted strip 112, thereby further compressing the paste into the structure of the strip.

While embodiments have been illustrated and described in the drawings and foregoing description, such illustrations and descriptions are considered to be exemplary and not restrictive in character, it being understood that only illustrative embodiments have been shown and described and that all changes and modifications that come within the spirit of the disclosure are desired to be protected.

For example, it should be appreciated that heat radiating from the rollers 114 (114A, 114B) may be circulated through the dryer 104 to assist in the drying process. In one embodiment variation, fans and/or blowers (not shown) may be incorporated in the contact flash dryer 104 to circulate heat radiating from the rollers throughout the dryer 104 to further assist in the paste drying process.

Further, although illustrated embodiments have been described in connection with the disposition of lead oxide paste on battery plate grids, it should be appreciated that the disclosure embodiments may be used in connection with disposition of various materials on different types of components during manufacture of such components. Therefore, the paste dried by the contact flash dryer designed in accordance with the disclosure embodiments may be of a type other then lead oxide. Moreover, the component upon which the paste is disposed need not be a strip, in particular a continuous strip as described above. Therefore, the illustrated embodiments may be utilized for a variety of applications as understood by one of ordinary skill in the art.

The applicants have provided description and figures which are intended as illustrations of embodiments of the disclosure, and are not intended to be construed as containing or implying limitation of the disclosure to those embodiments. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure and the appended claims.

The invention claimed is:

1. A flash dryer apparatus comprising:

a first plurality of heated rollers rotating in a first direction, the heating and rotation of each of the first plurality of heated rollers being individually controlled;

a second plurality of heated rollers rotating in a second direction, the heating and rotation of each of the second plurality of heated rollers being individually controlled and a control system configured to individually control rotation and heating of each of the heated rollers, wherein the first and second pluralities of heated rollers are provided in proximity to one another such that material carrying paste may be carried along a path provided between the first and second pluralities of heated rollers by contact with the first and second pluralities of heated rollers, wherein the contact of the first and second pluralities of heated rollers removes moisture from the paste carried on the material, wherein a speed of rotation and heating of each of the rollers included in first and second plurality of heated rollers are controlled by the control system on an individual basis, wherein the control of the heating of each heated roller is performed based on a feedback signal generated in each of the rollers indicating a surface temperature of the respective roller and wherein a rotation rate of each of the rollers is also controlled on an individual basis, and wherein a rotary coupler unit is provided for each of the heated rollers, each rotary coupler unit controlling heating thereof on an individual basis thereof as well as providing both electrical and data signal connection as well as maintaining that ability of each heated roller to rotate.

2. The flash dryer apparatus of claim 1, wherein the material carrying the paste is a continuous strip including a plurality of battery grid plates.

3. The flash dryer apparatus of claim 1, wherein the first direction is a counter clockwise direction and the second direction is a clockwise direction.

4. The flash dryer apparatus of claim 1, further comprising an upper carriage holding the first plurality of heated rollers and a lower carriage holding the second plurality of heated rollers.

5. The flash dryer apparatus of claim 4, further comprising a plurality of stop shim assemblies provided between the upper carriage and the lower carriage, the stop shim assemblies being configured to enable alteration of a distance between the upper carriage and the lower carriage so as to alter a distance between the plurality of first heated rollers and the plurality of second heated rollers.

6. The flash dryer apparatus of claim 1, wherein control of the rotation of the heated rollers is performed by the control system based on a feedback loop.

7. The flash dryer apparatus of claim 1, wherein the control system controls rotation of each heated roller of the first and second pluralities of heated rollers based on an operation rate of equipment preceding the flash dryer apparatus in a manufacturing line.

8. The flash dryer apparatus of claim 7, wherein the equipment preceding the flash dryer apparatus is pasting equipment configured to deposit paste on the material.

9. The flash dryer apparatus of claim 1, further comprising a plurality of scraper blades, each scraper blade corresponding to a heated roller of the first and second pluralities of heated rollers, wherein each scraper blade is positioned to contact and remove at least a portion of heated paste adhered to the heated roller.

10. The flash dryer apparatus of claim 9, further comprising a ventilation system provided in close proximity to the first and second pluralities of heated rollers and configured to operate to evacuate dried paste removed from the heated rollers out of an interior of the flash dryer apparatus.

11. The flash dryer apparatus of claim 10, wherein the ventilation system includes a plurality of ventilation ducts configured to remove paste dust suspended in air in the interior of the apparatus.

12. The flash dryer apparatus of claim 1, wherein the paste is lead oxide paste.

13. A flash drying method comprising:

rotating a first plurality of heated rollers in a first direction, the heating and rotation of each one of the first plurality of heated rollers being individually controlled by a control system on an individual basis; and rotating a second plurality of heated rollers in a second direction, the heating and rotation of each one of the second plurality of heated rollers being individually controlled by a control system on an individual basis, wherein the first and second pluralities of heated rollers are provided in proximity to one another such that material carrying paste may be carried along a path provided between the first and second pluralities of heated rollers by contact with the first and second pluralities of heated rollers, the method further comprising controlling heating of each of the heated rollers using a rotary coupler unit provided for each of the heated rollers, wherein the control of the heating of each of the heated rollers is performed on an individual basis and wherein a rotation rate of each of the rollers is also controlled on an individual basis, wherein each of the rotary coupler units provides both electrical and data signal connection as well as maintaining that ability of each heated roller to rotate, and wherein the control of the heating of each heated roller is performed based on a feedback signal generated in each of the rollers indicating a surface temperature of the respective roller and also based on the speed of rotation for each of the rollers.

14. The flash drying method of claim 13, wherein the material carrying the paste is a continuous strip including a plurality of battery grid plates.

15. The flash drying method of claim 13, wherein the first direction is a counter clockwise direction and the second direction is a clockwise direction.

16. The flash drying method of claim 13, wherein the first plurality of heated rollers are carried by an upper carriage and the second plurality of heated rollers are carried by a lower carriage, the upper and lower carriages being spaced apart from one another.

17. The flash drying method of claim 16, further comprising adjusting the distance between the upper and lower carriages by adjusting a plurality of stop shim assemblies provided between the upper carriage and the lower carriage, the stop shim assemblies being configured to enable alteration of a distance between the plurality of first heated rollers and the plurality of second heated rollers.

18. The flash drying method of claim 13, wherein the control of rotation of each heated roller of the first and second pluralities of heated rollers is based on an operation rate of equipment preceding equipment performing the flash drying method in a manufacturing line.

19. The flash drying method of claim 18, wherein the equipment preceding the equipment performing the flash dryer method is pasting equipment configured to deposit paste on the material.

20. The flash drying method of claim 13, further comprising removing at least a portion of heated pasted adhered to each of the heated rollers using a plurality of scraper blades, each scraper blade corresponding to a heated roller of the first and second pluralities of heated rollers, wherein each scraper blade is positioned to contact and remove at least a portion of heated paste adhered to the respective heated roller.

21. The flash drying method of claim 20, ventilating an area including the first and second pluralities of heated rollers so as to evacuate dried paste removed from the heated rollers.

22. The flash drying method of claim 21, wherein the ventilation of the area is performed using a plurality of ducts.

23. The flash drying method of claim 13, wherein the paste is lead oxide paste.

* * * * *